US007388595B2

(12) United States Patent
Yasuda et al.

(10) Patent No.: US 7,388,595 B2
(45) Date of Patent: Jun. 17, 2008

(54) FIXING DEVICE AND TEMPERATURE CONTROL METHOD

(75) Inventors: Akihiro Yasuda, Osaka (JP); Noriyuki Tajima, Osaka (JP); Hideki Tatematsu, Hyogo (JP); Koichi Baba, Osaka (JP); Shigemitsu Tani, Osaka (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 157 days.

(21) Appl. No.: 10/565,270

(22) PCT Filed: Oct. 5, 2004

(86) PCT No.: PCT/JP2004/014647

§ 371 (c)(1),
(2), (4) Date: Apr. 11, 2006

(87) PCT Pub. No.: WO2005/038532

PCT Pub. Date: Apr. 28, 2005

(65) Prior Publication Data

US 2007/0019063 A1 Jan. 25, 2007

(30) Foreign Application Priority Data

Oct. 17, 2003 (JP) ..... 2003-358025
Oct. 20, 2003 (JP) ..... 2003-360040

(51) Int. Cl.
*G03G 15/20* (2006.01)

(52) U.S. Cl. ..... 347/156; 399/328; 399/344

(58) Field of Classification Search ..... 347/156, 347/212; 399/328, 334
See application file for complete search history.

(56) References Cited

U.S. PATENT DOCUMENTS 6,400,924 B1 * 6/2002 Watanabe ..... 399/333
6,423,941 B1 * 7/2002 Kanari et al. ..... 217/216

(Continued)

FOREIGN PATENT DOCUMENTS

JP 2-157782 6/1990

(Continued)

OTHER PUBLICATIONS

Computer-generated translation of JP 2002-072763.*

(Continued)

*Primary Examiner*—Huan H Tran
(74) *Attorney, Agent, or Firm*—Greenblum & Bernstein, P.L.C.

(57) ABSTRACT

As a cooling mechanism that cools the entire paper passage area of a heat-producing belt, a rotational drive method of the heat-producing belt is employed and the heat-producing belt is cooled by rotational cooling by being made to idle when paper is not being passed through. An excitation apparatus and the above-described cooling mechanism are controlled so that recording paper is not passed through and the heat-producing belt is cooled while being heated over the heating width when the small-size recording paper is passed through until the temperature detected by a paper non-passage area temperature detecting sensor is at or below a predetermined fixing temperature. This fixing apparatus enables an excessive rise in temperature of a paper non-passage area of the heat-producing belt to be efficiently eliminated, and the temperature distribution of heat-producing belt to be made uniform in a short time.

23 Claims, 17 Drawing Sheets

U.S. PATENT DOCUMENTS

| | | | | |
|---|---|---|---|---|
| 6,438,335 | B1 * | 8/2002 | Kinouchi et al. | 399/67 |
| 6,625,417 | B1 | 9/2003 | Terada et al. | |
| 7,099,616 | B2 * | 8/2006 | Kato et al. | 399/328 |
| 7,215,919 | B2 * | 5/2007 | Kinouchi et al. | 399/334 |
| 2002/0141775 | A1 | 10/2002 | Mitsuoka et al. | |
| 2002/0190060 | A1 * | 12/2002 | Imai et al. | 219/619 |
| 2003/0152406 | A1 | 8/2003 | Terada et al. | |
| 2003/0170055 | A1 | 9/2003 | Terada et al. | |
| 2004/0081490 | A1 | 4/2004 | Terada et al. | |
| 2004/0253027 | A1 * | 12/2004 | Kato et al. | 399/328 |
| 2005/0199613 | A1 | 9/2005 | Samei et al. | |
| 2005/0201768 | A1 | 9/2005 | Tatematsu et al. | |
| 2006/0072931 | A1 | 4/2006 | Asakura et al. | |
| 2006/0099001 | A1 | 5/2006 | Asakura et al. | |
| 2006/0147221 | A1 * | 7/2006 | Asakura et al. | 399/69 |
| 2007/0014599 | A1 * | 1/2007 | Yasuda et al. | 399/328 |
| 2007/0014601 | A1 * | 1/2007 | Yasuda et al. | 399/329 |
| 2007/0122214 | A1 * | 5/2007 | Samei et al. | 399/329 |

FOREIGN PATENT DOCUMENTS

| | | |
|---|---|---|
| JP | 10-074009 | 3/1998 |
| JP | 10-083130 | 3/1998 |
| JP | 10-326054 | 12/1998 |
| JP | 2001-201978 | 7/2001 |
| JP | 2002-072763 | 3/2002 |
| JP | 2002-236429 | 8/2002 |
| JP | 2002-357967 | 12/2002 |
| JP | 2003-066762 | 3/2003 |
| JP | 2003-076209 | 3/2003 |
| JP | 2003-151722 | 5/2003 |
| JP | 2003-173103 | 6/2003 |
| JP | 2003-215958 | 7/2003 |
| JP | 2004-265670 | 9/2004 |

OTHER PUBLICATIONS

English Language Abstract of JP 10-074009.
English Language Abstract of JP 2003-173103.
English Language Abstract of JP 2002-357967.
English Language Abstract of JP 2003-151722.
English Language Abstract of JP 2004-265670.
English Language Abstract of JP 10-326054.
English Language Abstract of JP 2-157782.
English Language Abstract of JP 10-083130.
U.S. Appl. No. 10/575,356 to Yasuda et al., filed Apr. 11, 2006.
U.S. Appl. No. 10/575,353 to Yasuda et al., filed Apr. 11, 2006.
U.S. Appl. No. 10/576,307 to Samei et al., filed Apr. 11, 2006.
English language Abstract and partial translation of JP 2002-072763.
English language Abstract and partial translation of JP 2001-201978.
English language Abstract and partial translation of JP 2003-076209.
English language Abstract and partial translation of JP 2003-066762.
English language Abstract of JP 2002-236429.
English language Abstract of JP 2003-215958.

* cited by examiner

FIXING DEVICE AND TEMPERATURE CONTROL METHOD

TECHNICAL FIELD

The present invention relates to a fixing apparatus useful for employment in an image forming apparatus such as an electrophotographic or electrostatographic copier, facsimile machine, or printer, and more particularly to a fixing apparatus that heat-fixes an unfixed image onto a recording medium using induction heating, and a temperature control method.

BACKGROUND ART

An induction heating (IH) type of fixing apparatus generates an eddy current in a heat-producing element through the action of a magnetic field generated by a magnetic field generation unit, and heat-fixes an unfixed image on a recording medium such as transfer paper or an OHP sheet through Joule heating of the heat-producing element by means of the eddy current. An advantage of this induction heating type of fixing apparatus compared with a heat roller type of fixing apparatus that uses a halogen lamp as a heat source is that heat production efficiency is higher and the fixing speed can be increased.

With this kind of fixing apparatus, startup responsiveness when the heat-producing element is heated can be markedly improved by using a heat-producing roller comprising a thin sleeve or a heat-producing belt comprising an endless belt as the heat-producing element, and making the thermal capacity of the heat-producing element low.

With this kind of fixing apparatus, if heat-fixing is performed of small-size paper with a paper width smaller than the heating width of the heat-producing element when a paper passage area of large-size paper of the heat-producing element has been heated, the temperature of the paper passage area of small-size paper of the heat-producing element falls after that heat-fixing. This is because heat of the paper passage area of the heat-producing element is absorbed by the small-size paper passed through.

Thus, in this kind of fixing apparatus, in order to suppress the occurrence of fixing defects due to this fall in temperature of the heat-producing element due to the passage of small-size paper, the heat-producing element is heated with heating power greater than the normal heating power when paper is not passed through, and the temperature of a paper passage area of small-size paper of the heat-producing element is maintained at a predetermined fixing temperature.

Therefore, with this kind of fixing apparatus, when a paper passage area of small-size paper of the heat-producing element is heated with high heating power, a paper non-passage area of the heat-producing element is heated due to the effect of this heating. As a result, with this fixing apparatus, a paper non-passage area of the heat-producing element experiences an excessive rise in temperature and temperature distribution in the width direction of the heat-producing element becomes uneven, and when large-size paper is passed through, glossiness abnormalities and hot offset of a fixed image tend to occur. The temperature difference between a paper passage area and paper non-passage area of the heat-producing element due to this kind of excessive rise in temperature of a paper non-passage area of the heat-producing element increases with the quantity of small-size paper of the same width passed through continuously.

A known technology for eliminating the above-described excessive rise in temperature of a paper non-passage area is one whereby, of the magnetic flux generated by an exciting apparatus that performs induction heating of the heat-producing element, only magnetic flux that acts on a paper non-passage area of the heat-producing element is absorbed by a magnetic flux absorption member capable of moving in the paper passage area width direction of the heat-producing element, and heat production of a paper non-passage area of the heat-producing element is suppressed (see, for example, Patent Document 1 and so forth).

Another known technology for eliminating the above-described excessive rise in temperature of the paper non-passage area is one whereby, based on an image forming condition such as the recording medium size, alternation is performed between rotational cooling that cools by idling a heating roller serving as the heat-producing element and a pressure roller, and static cooling whereby cooling is performed with rotation of the heating roller and pressure roller stopped (see, for example, Patent Document 2 and so forth).

FIG. 1 is a schematic oblique drawing of a sample implementation of a fixing apparatus disclosed in Patent Document 1. As shown in FIG. 1, this fixing apparatus is provided with a coil assembly 10, a metal sleeve 11, a holder 12, a pressure roller 13, a magnetic flux masking shield 31, a displacement mechanism 40, and so forth.

In FIG. 1, coil assembly 10 generates a high-frequency magnetic field. Metal sleeve 11 is heated by an induction current induced by an induction coil 18 of coil assembly 10, and rotates in the direction of transportation of recording material 14. Coil assembly 10 is supported inside holder 12. Holder 12 is fixed to a fixing unit frame (not shown) and does not rotate. Pressure roller 13 rotates in the direction of transportation of recording material 14 while pressing against metal sleeve 11 and forming a nip area. By having recording material 14 gripped and transported by means of this nip area, an unfixed image on recording material 14 is heat-fixed to recording material 14 by metal sleeve 11.

As shown in FIG. 1, magnetic flux masking shield 31 exhibits an arc-shaped curved surface that mainly covers the upper half of induction coil 18, and is advanced and withdrawn with respect to the gap at either end of coil assembly 10 and holder 12 by means of displacement mechanism 40. Displacement mechanism 40 has a wire 33 linked to magnetic flux masking shield 31, a pair of pulleys 36 on which wire 33 is suspended, and a motor 34 that rotates one of the pulleys 36.

When the size of recording material 14 is the maximum size, magnetic flux masking shield 31 is moved by means of displacement mechanism 40 so as to be withdrawn into the position shown by the solid line in FIG. 1. On the other hand, when the size of recording material 14 is small, magnetic flux masking shield 31 is moved so as to advance into the position shown by the dot-dot-dash line in FIG. 1. By this means, magnetic flux reaching a paper non-passage area of metal sleeve 11 from induction coil 18 is masked, and an excessive rise in temperature of the paper non-passage area is suppressed.

FIG. 2 is a characteristic graph showing the characteristic of surface temperature with respect to axial direction position of a heating roller in a fixing apparatus disclosed in Patent Document 2. In this fixing apparatus, when the heat-fixing of small-size paper is performed repeatedly, the surface temperature distribution of the heating roller shows a considerable rise in paper non-passage areas at either side of the paper passage area immediately after passage of the aforementioned small-size paper, as shown by the solid line in FIG. 2.

Thus, in this fixing apparatus, in the above-described situation, the heating roller is cooled by alternating between above-described rotational cooling and above-described static cooling. That is to say, the surface temperature of the heating roller is lowered by the rotational cooling as shown by the dot-dash line in FIG. 2, and the surface temperature of the heating roller is made uniform by the static cooling as shown by the dot-dot-dash line in FIG. 2.

Patent Document 1: Unexamined Japanese Patent Publication No. HEI 10-74009

Patent Document 2: Unexamined Japanese Patent Publication No. 2003-173103

DISCLOSURE OF INVENTION

Problems to be Solved by the Invention

However, in the case of a fixing apparatus disclosed in Patent Document 1, as shown in FIG. 3 (a drawing showing part of a cross-section viewed from the paper passage direction, provided to explain the action), paper passage area magnetic flux generated by coil assembly 10 flows into a paper non-passage area of metal sleeve 11 in which magnetic flux masking shield 31 is located. This is because metal sleeve 11 is of a magnetic material. A paper non-passage area of the heat-producing element rises in temperature because of slight leakage flux due to this diverted flow of magnetic flux. Therefore, with this fixing apparatus, it is difficult to completely eliminate a rise in temperature of a paper non-passage area of the heat-producing element.

Also, through-holes 35 are formed in magnetic flux masking shield 31 to suppress its own heat production due to eddy currents. Therefore, magnetic flux reaches metal sleeve 11 and a paper non-passage area of metal sleeve 11 rises in temperature.

In a fixing apparatus disclosed in Patent Document 2, the heating width of the heat-producing element is switched by means of on/off switching of a plurality of halogen lamps (heaters) provided in a paper passage area and paper non-passage area of the heat-producing element, and therefore light of a halogen lamp of a paper passage area leaks into a paper non-passage area of the heat-producing element, and that paper non-passage area rises in temperature. Consequently, in this fixing apparatus the temperature of a paper non-passage area of the heat-producing element rises in temperature in the same way as in a fixing apparatus of Patent Document 1. Also, with this fixing apparatus, since the temperature of the heat-producing element is lowered uniformly by rotational cooling and static cooling of the heat-producing element, it is necessary to raise the temperature again, and it takes a considerable time until the next heat-fixing operation is possible. Moreover, since static cooling of the heat-producing element is a method whereby temperature unevenness of the heat-producing element is eliminated by the transfer of heat from a paper non-passage area to a paper passage area using thermal capacity in the vicinity of the nip area of the heat-producing element, in a fixing apparatus in which the thermal capacity of the heat-producing element has been made small, it takes a considerable time for the temperature distribution of the heat-producing element to become uniform.

Thus, with a conventional fixing apparatus of this kind, even though an excessive rise in temperature of a paper non-passage area of the heat-producing element can be suppressed to some extent, it is difficult for this rise in temperature of a paper non-passage area to be completely prevented. Therefore, a defect of a conventional fixing apparatus of this kind is that if, for example, after a large quantity of A5 size paper, A4 size paper, B4 size paper, or suchlike paper smaller than the maximum-size A3 size paper has been passed through continuously, switchover is performed to passage of recording paper larger in size than this passed-through paper, hot offset occurs due to an excessive rise in temperature of an area that was a paper non-passage area of the heat-producing element prior to this switchover, unevenness of glossiness of a fixed image occurs, and image quality deteriorates.

Various other kinds of fixing apparatus with a configuration such that the heating width of the heat-producing element is variable, as described above, have been proposed, but a problem with all such fixing apparatuses is that a rise in temperature of a paper non-passage area of the heat-producing element cannot be completely prevented, and defects occur due to this excessive rise in temperature of a paper non-passage area of the heat-producing element.

It is therefore an object of the present invention to provide a fixing apparatus and temperature control method that enable an excessive rise in temperature of a paper non-passage area in the paper passage width direction of a heat-producing element to be efficiently eliminated, and the temperature distribution of the heat-producing element to be made uniform in a short time.

Means for Solving the Problems

The present invention is a fixing apparatus in which a recording medium is not passed through and a heat-producing element is cooled by means of a cooling mechanism while being heated by means of a heating apparatus over the heating width when small-size recording medium is passed through until the temperature of a paper non-passage area of the heat-producing element is at or below a predetermined temperature at which fixing is possible.

A fixing apparatus of the present invention has: a heat-producing element that heat-fixes an unfixed image on a recording medium onto that recording medium; a heating apparatus that heats the aforementioned heat-producing element; a cooling apparatus that cools the entire paper passage area of the aforementioned heat-producing element; a heating width changing apparatus that changes the heating width of the aforementioned heat-producing element so that, when a recording medium of smaller size than the maximum heating width of the aforementioned heat-producing element is passed through, the paper passage width of that small-size recording medium is made to produce heat; and a control section that performs uniformizing control that directs the aforementioned heating apparatus and also directs the aforementioned cooling apparatus so that the aforementioned recording medium is not passed through, and heating of a heating width that causes the paper passage area of the aforementioned recording medium of the aforementioned small size to produce heat is maintained and the entire paper passage width of the aforementioned heat-producing element is cooled, until a paper non-passage area of the aforementioned heat-producing element is at or below a temperature at which fixing is possible.

Advantageous Effects of the Invention

According to the present invention, an excessive rise in temperature of a paper non-passage area in the paper passage width direction of a heat-producing element can be efficiently eliminated, and the temperature distribution of the heat-producing element can be made uniform in a short time.

BEST MODE FOR CARRYING OUT THE INVENTION

Figure 1:
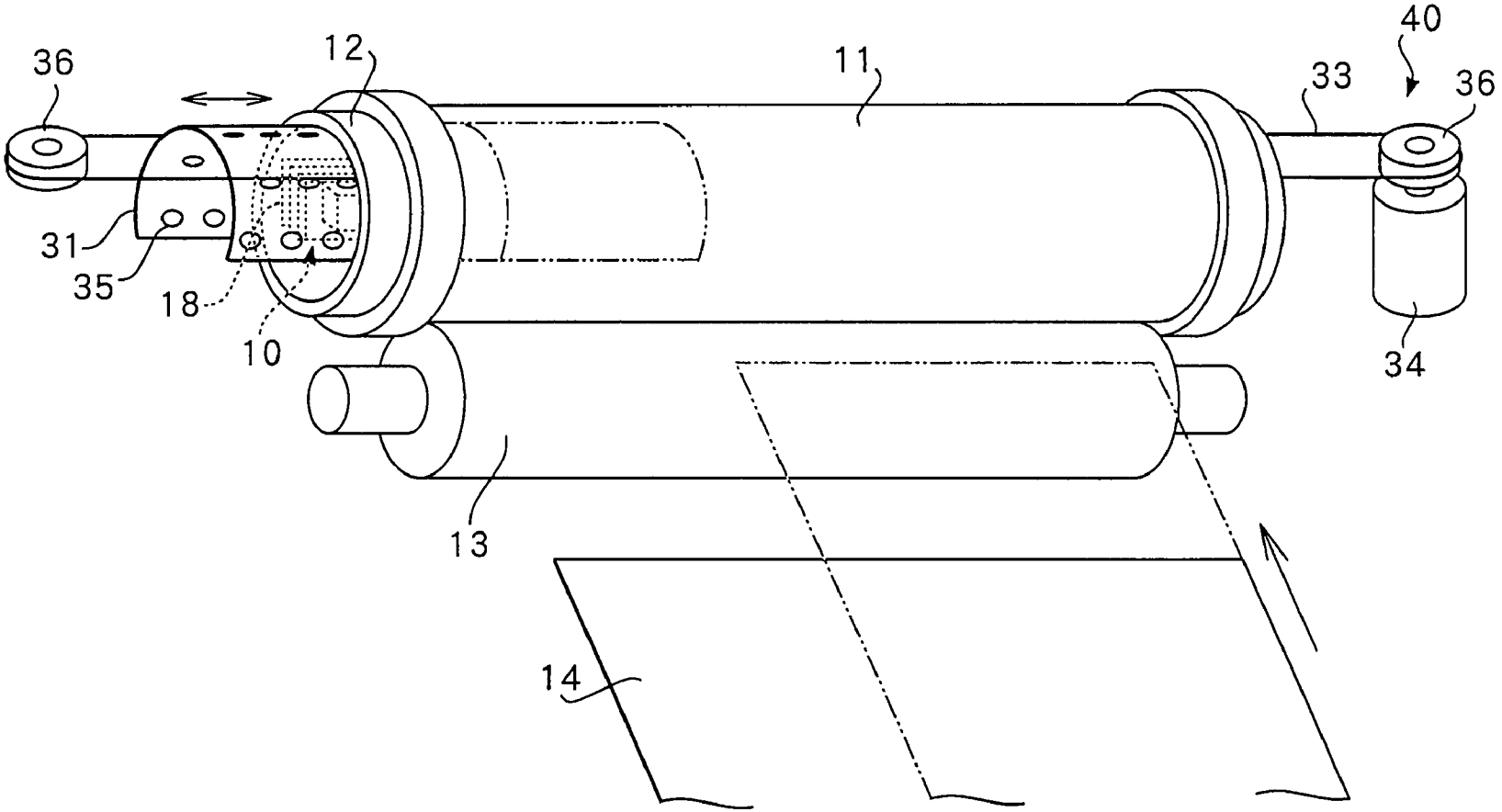
(PRIOR ART) FIG. 1
FIG. 1 is a schematic oblique drawing showing the configuration of a conventional fixing apparatus.
Figure 2:
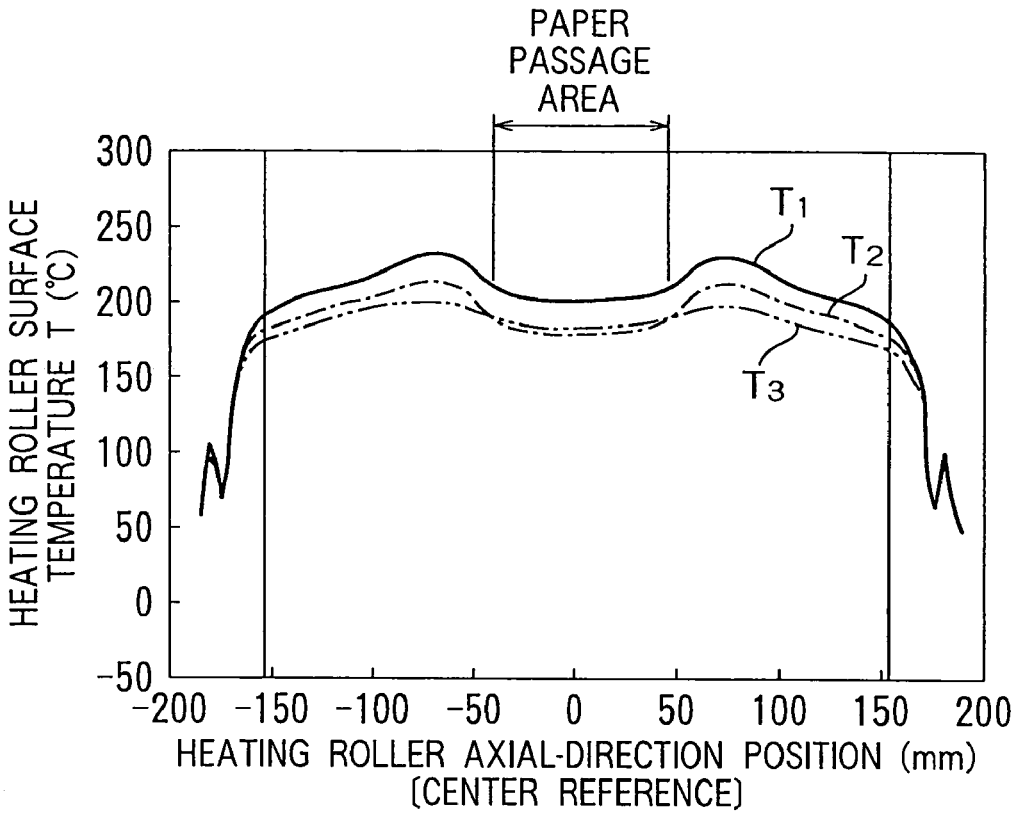
(PRIOR ART) FIG. 2
FIG. 2 is a graph showing the distribution of heat-producing temperature in the axial direction of a heating roller of another conventional fixing apparatus.

Embodiments of the present invention will now be described in detail with reference to the accompanying drawings. In the drawings, configuration elements and equivalent parts that have identical configurations or function are assigned the same codes, and descriptions thereof are not repeated.

EMBODIMENT 1

Figure 4:
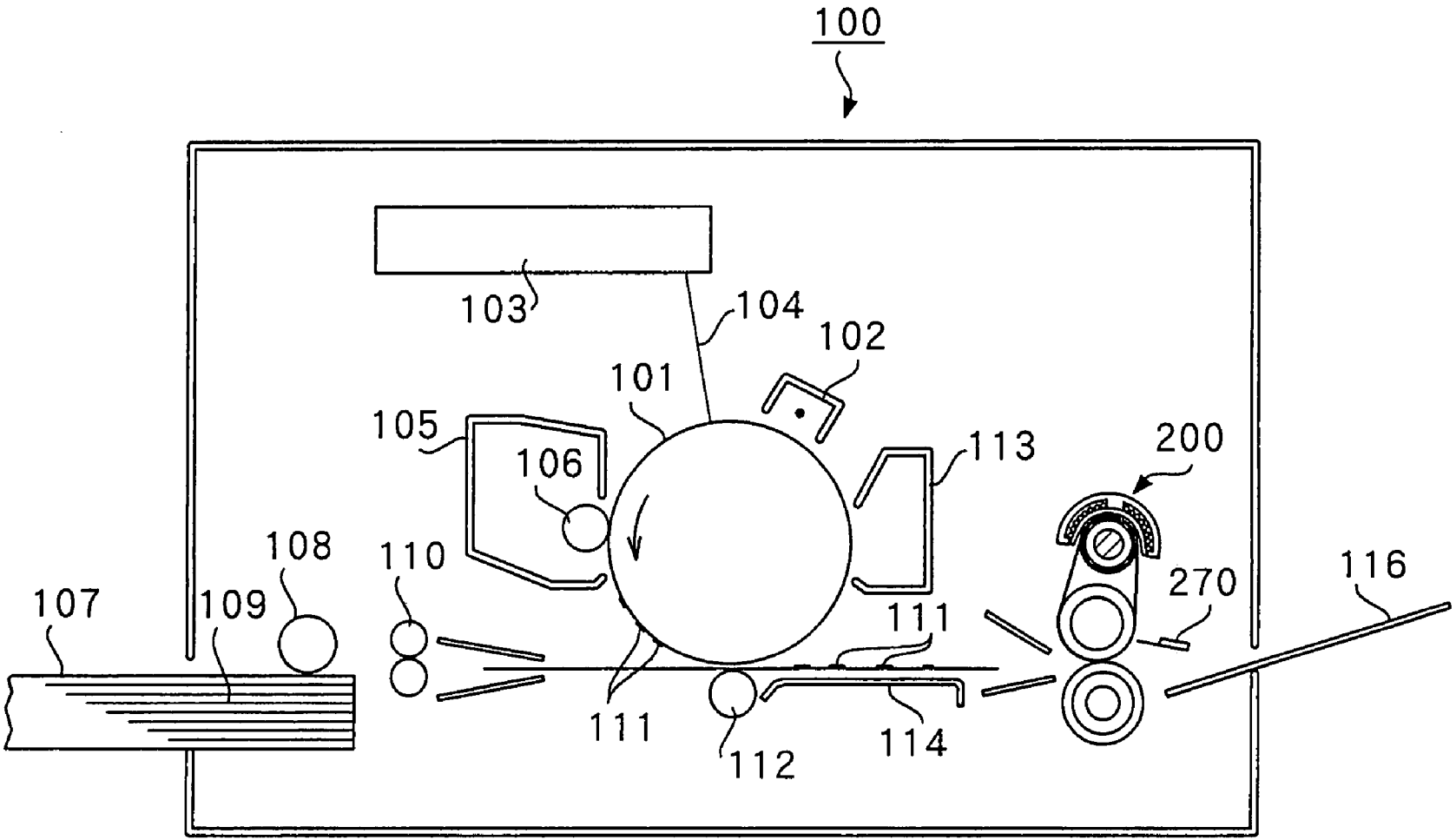
FIG. 4 is a schematic cross-sectional view showing the overall configuration of an image forming apparatus suitable for incorporation of a fixing apparatus according to Embodiment 1 of the present invention.

FIG. 4 is a schematic cross-sectional view showing the overall configuration of an image forming apparatus suitable for incorporation of a fixing apparatus according to Embodiment 1 of the present invention.

As shown in FIG. 4, an image forming apparatus 100 has an electrophotographic photosensitive body (hereinafter referred to as "photosensitive drum") 101, an electrifier 102, a laser beam scanner 103, a developing unit 105, a paper feed apparatus 107, a fixing apparatus 200, a cleaning apparatus 113, and so forth.

In FIG. 4, photosensitive drum 101 is rotated at a predetermined peripheral velocity in the direction indicated by the arrow while its surface is uniformly charged to a negative predetermined dark potential V0 by electrifier 102.

Laser beam scanner 103 outputs a laser beam 104 modulated in accordance with a time series electrical digital pixel signal of image information input from a host apparatus such as an image reading apparatus or computer (not shown), and performs scanning exposure of the surface of uniformly charged photosensitive drum 101 with laser beam 104. By this means, the absolute value of the potential of exposed parts of photosensitive drum 101 falls and becomes a light potential VL, and an electrostatic latent image is formed on the surface of photosensitive drum 101.

Developing unit 105 is provided with a rotated developing roller 106. Developing roller 106 is positioned opposite photosensitive drum 101, and a thin layer of toner is formed on its peripheral surface. A developing bias voltage with an absolute value smaller than dark potential V0 of photosensitive drum 101 and larger than light potential VL is applied to developing roller 106.

By this means, negatively charged toner on developing roller 106 adheres only to light potential VL parts of the surface of photosensitive drum 101, the electrostatic latent image formed on the surface of photosensitive drum 101 is developed, and an unfixed toner image 111 is formed on photosensitive drum 101.

Meanwhile, paper feed apparatus 107 feeds recording paper 109 as a recording medium one sheet at a time at predetermined timing by means of a paper feed roller 108. Recording paper 109 fed from paper feed apparatus 107 is transported through a pair of registration rollers 110 to the nip area between photosensitive drum 101 and a transfer roller 112 at appropriate timing synchronized with the rotation of photosensitive drum 101. By this means, unfixed toner image 111 on photosensitive drum 101 is transferred to recording paper 109 by transfer roller 112 to which a transfer bias is applied.

Recording paper 109 on which unfixed toner image 111 is formed and held in this way is guided by a recording paper guide 114 and separated from photosensitive drum 101, and then transported toward the fixing area of fixing apparatus 200. Once transported to this fixing area, recording paper 109 has unfixed toner image 111 heat-fixed onto it by fixing apparatus 200.

After passing through fixing apparatus 200, recording paper 109 onto which unfixed toner image 111 has been heat-fixed is ejected onto an output tray 116 attached to the outside of image forming apparatus 100.

After recording paper 109 has been separated from it, photosensitive drum 101 has residual material such as untransferred toner remaining on its surface removed by a cleaning apparatus 113, and is made ready for the next image forming operation.

Figure 5:
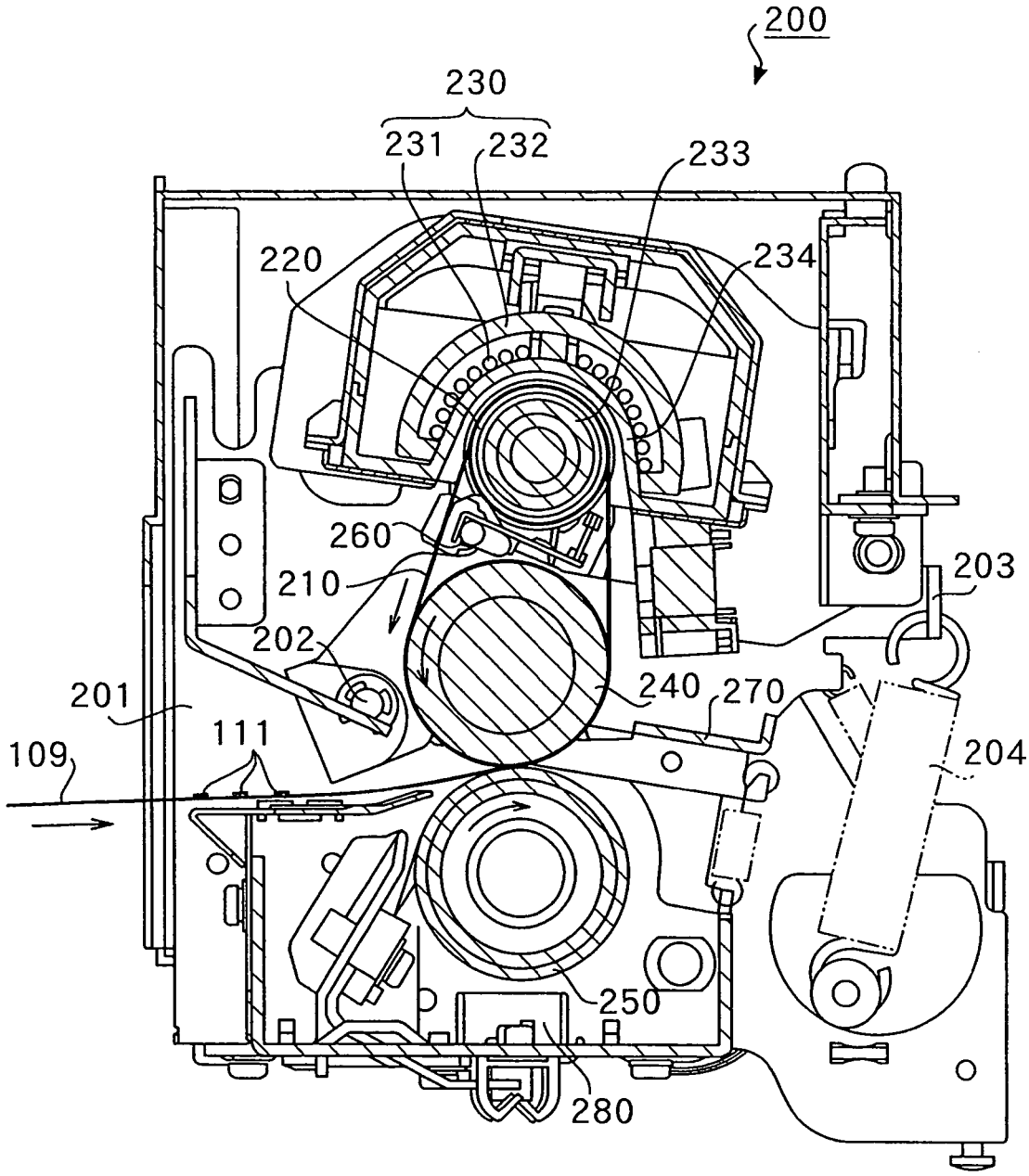
FIG. 5 is a cross-sectional view showing the basic configuration of a fixing apparatus according to Embodiment 1 of the present invention.
Figure 6:
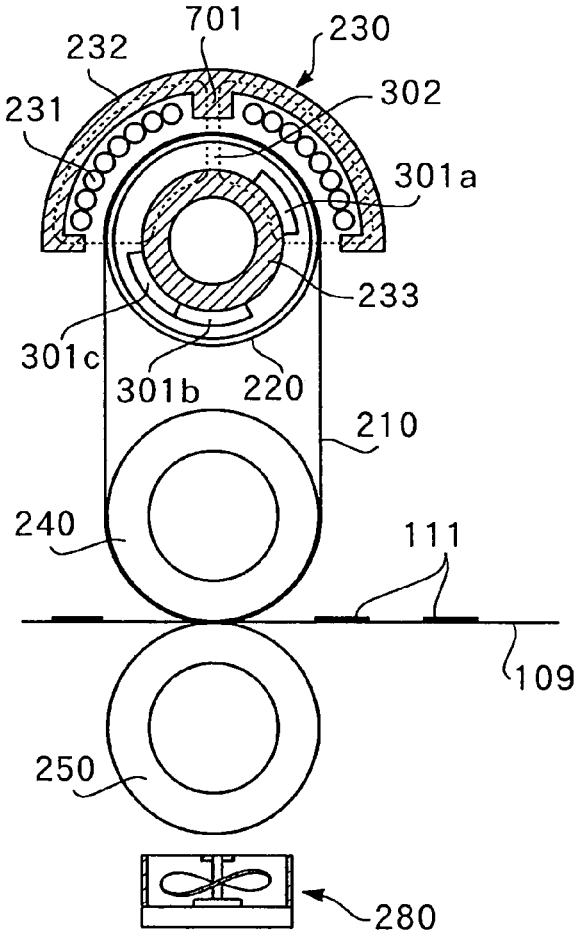
FIG. 6 is a schematic cross-sectional view showing the configuration of the principal parts of a fixing apparatus according to Embodiment 1 of the present invention.

A fixing apparatus according to Embodiment 1 will now be described in greater detail by giving a specific example. FIG. 5 is a cross-sectional view showing the configuration of a fixing apparatus according to Embodiment 1, and FIG. 6 is a schematic cross-sectional view showing the configuration of only the principal parts of a fixing apparatus according to Embodiment 1. As shown in FIG. 5 and FIG. 6, fixing apparatus 200 includes a heat-producing belt 210, a supporting roller 220 serving as a belt supporting member, an excitation apparatus 230 serving as an induction heating section, a fixing roller 240, a pressure roller 250 serving as a belt rotation section, and so forth.

In FIG. 5 and FIG. 6, heat-producing belt 210 is suspended between supporting roller 220 and fixing roller 240. Supporting roller 220 is rotatably pivoted in the upper part of body side plate 201 of fixing apparatus 200. Fixing roller 240 is rotatably pivoted in a rocking plate 203 attached in a freely rocking fashion to body side plate 201 by means of a short shaft 202. Pressure roller 250 is rotatably pivoted in the lower part of body side plate 201 of fixing apparatus 200.

Rocking plate 203 rocks in a clockwise direction about short shaft 202 through the contracting action of a coil spring 204. Fixing roller 240 is displaced in line with this rocking of rocking plate 203, and through this displacement presses against pressure roller 250 with heat-producing belt 210 inbetween. Supporting roller 220 is energized in the opposite direction to fixing roller 240 by a spring (not shown), by which means predetermined tension is imparted to heat-producing belt 210.

Pressure roller 250 is rotated in the direction indicated by the arrow by a driving source (not shown). Fixing roller 240 is rotated driven by the rotation of pressure roller 250 while gripping heat-producing belt 210. By this means, heat-producing belt 210 is rotated in the direction indicated by the arrow, gripped between fixing roller 240 and pressure roller 250. By means of this gripping and rotation of heat-producing belt 210, a nip area for heat-fixing unfixed toner image 111 onto recording paper 109 is formed between heat-producing belt 210 and pressure roller 250.

Excitation apparatus 230 comprises an above-described IH type induction heating section, and as shown in FIG. 5 and FIG. 6, has an exciting coil 231 as a magnetism generation section installed along the outer peripheral surface of the part of heat-producing belt 210 suspended on supporting roller 220, and a core 232 composed of ferrite covering exciting coil 231. Exciting coil 231 extends in the paper passage width direction and is wound so as to loop back following the direction of movement of fixing belt 210. Inside supporting roller 220 is provided an opposed core 233 that is opposite exciting coil 231 with heat-producing belt 210 and supporting roller 220 inbetween.

Exciting coil 231 is formed using litz wire comprising bundled thin wires, and the cross-sectional shape is formed as a semicircle so as to cover the outer peripheral surface of heat-producing belt 210 suspended on supporting roller 220. An excitation current with a drive frequency of 25 kHz is applied to exciting coil 231 from an exciting circuit (not shown). By this means, an alternating field is generated between core 232 and opposed core 233, an eddy current is generated in the conductive layer of heat-producing belt 210, and heat-producing belt 210 produces heat. In this example, the configuration is such that heat-producing belt 210 produces heat, but a configuration may also be used whereby supporting roller 220 is made to produce heat, and heat from supporting roller 220 is transferred to heat-producing belt 210.

Core 232 is attached to the center and part of the rear of exciting coil 231. As an alternative to ferrite, a high-permeability material such as permalloy can also be used as the material of core 232 and opposed core 233.

In fixing apparatus 200, as shown in FIG. 5 and FIG. 6, unfixed toner image 111 can be heat-fixed onto recording paper 109 by transporting recording paper 109 to which unfixed toner image 111 has been transferred from the direction indicated by the arrow so that the surface bearing unfixed toner image 111 is brought into contact with heat-producing belt 210.

A temperature sensor 260 comprising a thermistor is positioned at the part of the rear surface of heat-producing belt 210 that has passed the area of contact with supporting roller 220. The temperature of heat-producing belt 210 is detected by this temperature sensor 260. The output of temperature sensor 260 is provided to a control apparatus (not shown). Based on the output of temperature sensor 260, this control apparatus controls the power supplied to exciting coil 231 via the aforementioned exciting circuit so that an optimal image fixing temperature is attained, and by this means the calorific value of heat-producing belt 210 is controlled.

Downstream in the recording paper 109 transportation direction, an ejection guide 270 that guides recording paper 109 toward output tray 116 after heat-fixing is finished is provided in the area where heat-producing belt 210 is suspended on fixing roller 240.

A coil guide 234 serving as a supporting member is also provided in excitation apparatus 230, integral with exciting coil 231 and core 232. This coil guide 234 is formed of a resin with a high heat-resistance temperature such as a PEEK material or PPS. The provision of coil guide 234 makes it possible to confine heat emitted from heat-producing belt 210 in the space between heat-producing belt 210 and exciting coil 231, and prevent damage to exciting coil 231.

Although core 232 shown in FIG. 5 and FIG. 6 has a semicircular cross-section, core 232 need not necessarily have a shape that follows the shape of exciting coil 231, and may, for example, have an approximately Π-shaped cross-section.

Heat-producing belt 210 comprises, for example, a thin endless belt with a diameter of 50 mm and thickness of 50 μm, with a conductive layer formed by dispersing silver powder in base material of polyimide resin with a glass transition point of 360 (° C.). The conductive layer may be composed of 2 or 3 laminated silver layers with a thickness of 10 μm. The surface of this heat-producing belt 210 may be coated with a 5 μm thick release layer of fluororesin (not shown) to provide releasability. It is desirable for the glass transition point of the material of heat-producing belt 210 to be in a range from 200 (° C.) to 500 (° C.). Resin or rubber with good releasability such as PTFE, PFA, FEP, silicone rubber, fluororubber, or the like, may be used, alone or mixed, for the release layer on the surface of heat-producing belt 210.

As an alternative to the above-mentioned polyimide resin, a heat-resistant resin such as fluororesin or metal such as an electroformed thin nickel sheet or thin stainless sheet can also be used as the base material of heat-producing belt 210. For example, heat-producing belt 210 may be configured by executing 10 μm thick copper plating on a 40 μm thick SUS430 (magnetic) or SUS304 (nonmagnetic) surface. For performing heating control of heat-producing belt 210 in the paper passage width direction (supporting roller 220 lengthwise direction) described later herein, it is desirable for at least 50% of magnetic flux to pass through heat-producing belt 210. It is therefore desirable for heat-producing belt 210 to be formed using a nonmagnetic material such as silver or copper. If heat-producing belt 210 is formed using a magnetic material, it should be made as thin as possible (preferably not more than 50 μm thick). For example, if a 40 μm thick nickel belt is used, when excitation apparatus 230 drive frequency f=25 kHz, a thickness of 40 μm is approximately half the skin depth of nickel (Ni), and approximately 60% of magnetic flux passes through heat-producing belt 210, facilitating heating control of heat-producing belt 210 in the paper passage width direction.

When heat-producing belt 210 is used as an image heating element for heat-fixing of monochrome images, it is sufficient to secure releasability, but when heat-producing belt 210 is used as an image heating element for heat-fixing of color images, it is desirable for elasticity to be provided by forming a thick rubber layer. The thermal capacity of heat-producing belt 210 should preferably be 60 J/K or less, and still more preferably 40 J/K or less.

Supporting roller 220 is a cylindrical metal roller 20 mm in diameter, 320 mm in length, and 0.2 mm thick. If the material of supporting roller 220 is as thin as 0.04 mm or so, a magnetic material such as iron or nickel may be used, although a nonmagnetic material that allows easy passage of magnetic flux is preferable. The material should be as insusceptible to the generation of eddy currents as possible, and use of a nonmagnetic stainless material with a specific resistance of 50 μΩcm or higher is desirable. A supporting roller 220 of the nonmagnetic stainless material SUS304 has a high specific resistance of 72 μΩcm as well as being nonmagnetic, and therefore magnetic flux that passes through supporting roller 220 is not greatly masked, and with 0.2 mm thick material, for example, the heat production of supporting roller 220 is extremely small. Also, a supporting roller 220 of SUS304 has good mechanical strength, enabling the thermal capacity to be further decreased by reducing the thickness to 0.04 mm, and is suitable for use in fixing apparatus 200 with this configuration. Supporting roller 220 should preferably have a relative permeability of 4 or less, and be from 0.04 mm to 0.2 mm in thickness.

Fixing roller 240 is 30 mm in diameter and made of silicone rubber, an elastic foam material with low surface hardness (here, JISA 30 degrees) and low thermal conductivity.

Pressure roller 250 is made of silicone rubber with a hardness of JISA 65 degrees. A heat-resistant resin or other rubber such as fluororubber or fluororesin may also be used as the material of pressure roller 250. It is also desirable for the surface of pressure roller 250 to be coated with resin or rubber such as PFA, PTFE, or FEP, alone or mixed, to increase wear resistance and releasability. Furthermore, it is desirable for pressure roller 250 to be made of a material with low thermal conductivity.

In fixing apparatus 200 according to Embodiment 1, when recording paper 109 of smaller size than the maximum heating width of heat-producing belt 210 is passed through, the heating width of heat-producing belt 210 is changed so that the paper passage width of this small-size recording paper 109 is made to produce heat, as shown in FIG. 6. For this purpose, three magnetism masking elements 301*a*, 301*b*, and 301*c* of a material that can mask magnetism are provided. A low-permeability electrical conductor such as copper or aluminum can be used as the material of these magnetism masking elements 301*a*, 301*b*, and 301*c*. These magnetism masking elements 301*a*, 301*b*, and 301*c* are positioned between excitation apparatus 230 serving as a magnetic flux generation section and opposed core 233, and are movably supported relative to excitation apparatus 230 in the direction of movement of heat-producing belt 210 serving as a heat-producing element that allows passage of magnetic flux.

Figure 7:
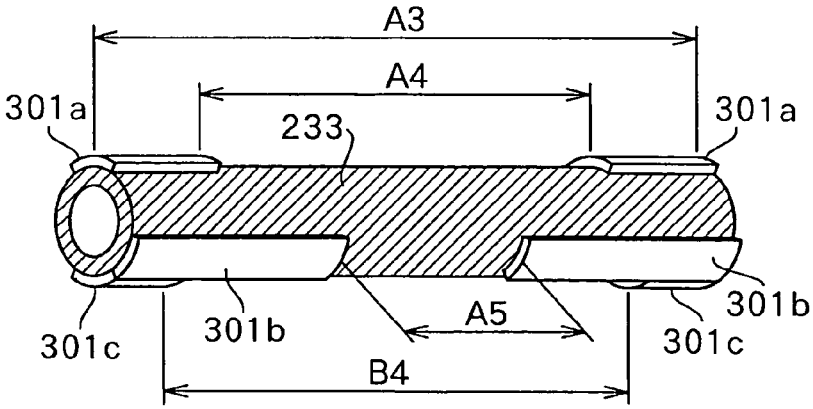
FIG. 7 is a schematic oblique drawing showing a configuration in which magnetism masking elements are provided at both ends of an opposed core of a fixing apparatus according to Embodiment 1 of the present invention.

In fixing apparatus 200 according to Embodiment 1, magnetism masking elements 301*a*, 301*b*, and 301*c* are configured so as to be displaced relative to excitation apparatus 230, and, for example, a tubular sleeve (not shown) mated with opposed core 233 can be used as a supporting member of these magnetism masking elements 301*a*, 301*b*, and 301*c*. In fixing apparatus 200 according to Embodiment 1, as shown in FIG. 7, opposed core 233 is used as a supporting member of magnetism masking elements 301*a*, 301*b*, and 301*c*.

In FIG. 6, magnetism masking elements 301*a*, 301*b*, and 301*c* are displaced to a magnetic path blocking position in which they block a magnetic path 302 corresponding to a paper non-passage area of heat-producing belt 210 between excitation apparatus 230 and opposed core 233, and a magnetic path clearing position in which they clear magnetic path 302.

Figure 8:
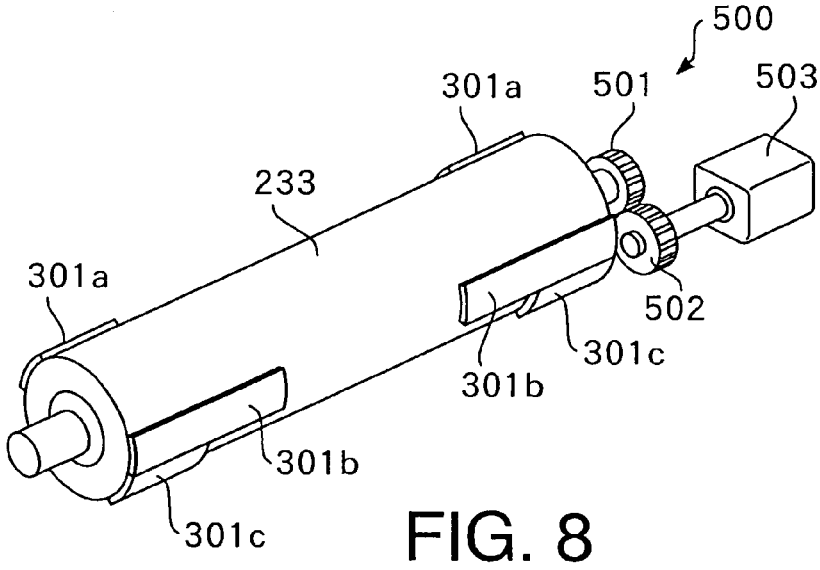
FIG. 8 is a schematic oblique drawing showing a magnetism masking element displacement mechanism that displaces magnetism masking elements by rotating an opposed core of a fixing apparatus according to Embodiment 1 of the present invention.

FIG. 8 is a schematic oblique drawing showing a displacement mechanism 500 that displaces magnetism masking elements 301 by rotating opposed core 233 constituting a supporting member of magnetism masking elements 301*a*, 301*b*, and 301*c*. As shown in FIG. 8, this displacement mechanism 500 is composed of a small gear wheel 501 attached to the spindle of opposed core 233, a large gear wheel 502 that meshes with small gear wheel 501, a stepping motor 503 that is axially connected to and rotates large gear wheel 502, and so forth.

Figure 9:
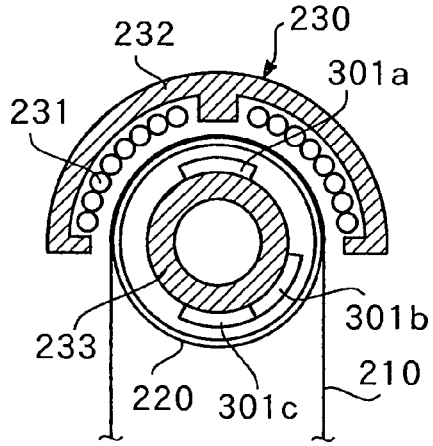
FIG. 9 is a schematic cross-sectional view showing a state in which magnetism masking elements of a fixing apparatus according to Embodiment 1 of the present invention have been displaced to the magnetic path blocking position.

In FIG. 8, when stepping motor 503 is turned on (energized), large gear wheel 502 is rotated by the rotation of the spindle of stepping motor 503, and small gear wheel 501 rotates driven by large gear wheel 502. Through this rotation in driven fashion of small gear wheel 501, the spindle of opposed core 233 rotates and, of magnetism masking elements 301*a*, 301*b*, and 301*c*, predetermined magnetism masking elements of a length corresponding to the paper non-passage area width of the passed-through recording paper size are displaced from their magnetic path clearing position to their magnetic path blocking position. Here, magnetism masking elements 301*a* are displaced from their magnetic path clearing position to their magnetic path blocking position as shown in FIG. 9. By this means, magnetic paths 302 corresponding to paper non-passage areas of heat-producing belt 210 between excitation apparatus 230 and opposed core 233 are blocked by magnetism masking elements 301*a*.

Figure 3:
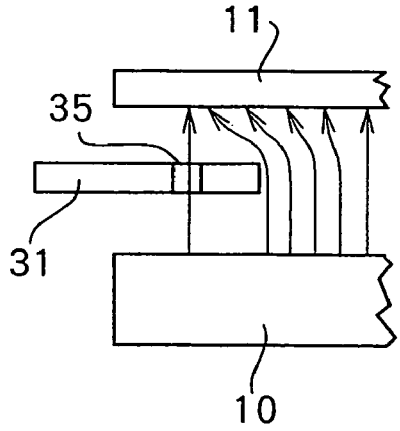
(PRIOR ART) FIG. 3
FIG. 3 is an action explanatory drawing explaining the action of a conventional fixing apparatus.
Figure 10:
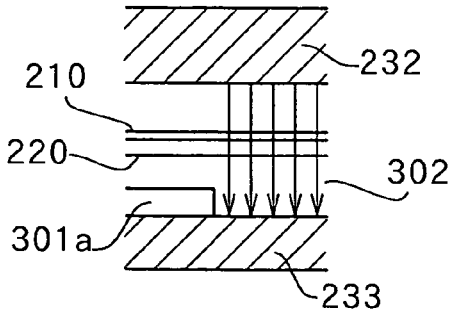
FIG. 10 is an action explanatory drawing explaining the action of a fixing apparatus according to Embodiment 1 of the present invention.

FIG. 10 is cross-sectional view for explaining the action viewed from the paper passage direction whereby a magnetic path 302 corresponding to a paper non-passage area of heat-producing belt 210 is blocked by a magnetism masking element 301*a*. As this fixing apparatus according to Embodiment 1 is configured with heat-producing belt 210 located between core 232 and opposed core 233 made of high-permeability material, a nonmagnetic material can be used for heat-producing belt 210. That is to say, when magnetism masking elements 301*a* are displaced to their magnetic path blocking position, diverted flow of magnetic flux such as shown in the example of the prior art in FIG. 3 does not occur. As a result, the efficacy of Embodiment 1 in suppressing an excessive rise in temperature of a paper non-passage area of heat-producing belt 210 is increased.

Since magnetic flux generally cannot be completely eliminated with aluminum, copper, or the like, paper non-passage areas of heat-producing belt 210 are slightly warmed by extremely weak magnetic flux passing through magnetism masking elements 301*a*, but in normal use an excessive rise in temperature does not occur in heat-producing belt 210 due to convection of the surrounding air.

On the other hand, when the entire width of the paper passage area of heat-producing belt 210 is made to produce heat, power to stepping motor 503 is cut with magnetism masking elements 301*a*, 301*b*, and 301*c* located in their respective above-described magnetic path clearing positions as shown in FIG. 6.

Thus, in this fixing apparatus, by turning stepping motor 503 of displacement mechanism 500 on and off, magnetic paths 302 corresponding to paper non-passage areas of heat-producing belt 210 between excitation apparatus 230 and opposed core 233 are blocked or cleared by magnetism masking elements 301*a*, 301*b*, and 301*c*, and the strength of magnetic coupling in the paper passage width direction between heat-producing belt 210 and exciting coil 231 is controlled.

Therefore, with this fixing apparatus, by selectively displacing magnetism masking elements 301*a*, 301*b*, and 301*c* from the above-described magnetic path clearing position to the magnetic path blocking position in accordance with the size of recording paper passed through, heat production of paper non-passage areas of heat-producing belt 210 corresponding to the size of recording paper 109 passed through is suppressed, enabling an excessive rise in temperature of recording paper 109 non-passage areas to be prevented. Therefore, with this fixing apparatus it is possible to achieve satisfactory heat-fixing of a plurality of sizes of recording paper 109 by means of heat-producing belt 210.

The positions of magnetism masking elements 301*a*, 301*b*, and 301*c* on opposed core 233 are decided in accordance with the paper passage reference of recording paper 109. Here, the paper passage reference of recording paper 109 is assumed to be the center reference, and magnetism masking elements 301*a*, 301*b*, and 301*c* are provided at both ends of opposed core 233, as shown in FIG. 7.

Magnetism masking elements 301*a*, 301*b*, and 301*c* in this fixing apparatus have lengths corresponding respectively to A4 size width, A5 size width, and B4 size width paper non-passage areas of heat-producing belt 210.

In other words, this fixing apparatus is configured with the provision of four paper-passage modes: an A3 size paper-passage mode, a B4 size paper-passage mode, an A4 size paper-passage mode, and an A5 size paper-passage mode.

That is to say, in paper-passage mode of A3 size recording paper 109, magnetism masking elements 301*a*, 301*b*, and 301*c* are all withdrawn to the above-described magnetic path clearing positions as shown in FIG. 6. As a result, magnetic path 302 is not blocked by any of magnetism masking elements 301*a*, 301*b*, or 301*c*, and a paper passage area of the entire width (A3 size width) of heat-producing belt 210 is heated.

In paper-passage mode of B4 size recording paper 109, the shortest of magnetism masking elements 301*a*, 301*b*, and 301*c*—that is, magnetism masking elements 301*c*—are positioned at the above-described magnetic path blocking position. As a result, magnetic path 302 is blocked by magnetism masking elements 301*c*, and only a paper passage area of heat-producing belt 210 corresponding to a B4 size width is heated.

In paper-passage mode of A4 size recording paper 109, the medium-length magnetism masking elements among magnetism masking elements 301*a*, 301*b*, and 301*c*—that is, magnetism masking elements 301*a*—are positioned at the above-described magnetic path blocking position. As a result, magnetic path 302 is blocked by magnetism masking elements 301*a*, and only a paper passage area of heat-producing belt 210 corresponding to an A4 size width is heated.

In paper-passage mode of A5 size recording paper 109, the longest of magnetism masking elements 301*a*, 301*b*, and 301*c*—that is, magnetism masking elements 301*b*—are positioned at the above-described magnetic path blocking position. As a result, magnetic path 302 is blocked by magnetism masking elements 301*b*, and only a paper passage area of heat-producing belt 210 corresponding to a B4 size width is heated.

The above-described paper-passage modes can also be supported by a fixing apparatus in which the above-described magnetism masking elements are configured as cutaway parts or recesses in opposed core 233 (not shown).

According to this fixing apparatus, it is possible to perform continuous heat-fixing of A3 size images and A4 size images as business documents, and continuous heat-fixing of B4 size images as official documents and school teaching materials, enabling this fixing apparatus to be used as a fixing apparatus of a multifunctional image forming apparatus.

With a conventional fixing apparatus of this kind, as stated above, it is difficult to eliminate an excessive rise in temperature due to diverted flow of magnetic flux of a paper non-passage area of the heat-producing element (heat-producing belt 210 in fixing apparatus 200 according to Embodiment 1).

Also, under severe conditions such as execution of large-volume, continuous, high-speed printing using small-size paper that has been kept in a low-temperature environment after heating has been performed for a long period and fixing apparatus 200 has been thoroughly warmed up, heat may gradually accumulate in paper non-passage areas of heat-producing belt 210, resulting in an excessive rise in temperature.

Also, with a conventional fixing apparatus of this kind, if paper non-passage areas of the heat-producing element have risen excessively in temperature due to passage of small-size paper, the heat-producing element is cooled in its entirety and raised in temperature again, and therefore it takes a considerable time until the next heat-fixing operation is possible. Furthermore, even if heat is transferred from a paper non-passage area to a paper passage area of the heat-producing element using thermal capacity in the vicinity of the nip area of the heat-producing element, if the thermal capacity of the heat-producing element is small, it takes a considerable time for the temperature distribution of the heat-producing element to become uniform.

Thus, in fixing apparatus 200 according to Embodiment 1, a paper non-passage area temperature detecting sensor 260*x* that detects the temperature of a paper non-passage area of heat-producing belt 210 is provided as shown in FIG. 6.

In this fixing apparatus 200 according to Embodiment 1, a rotational drive mechanism of heat-producing belt 210 is used as a cooling apparatus that cools the entire paper passage area of heat-producing belt 210, and heat-producing belt 210 is cooled by moving heat-producing belt 210 relative to the surrounding air by means of a rotational cooling method in which idling is performed when paper is not being passed through. This rotational cooling type of cooling apparatus does not require the provision of a new member for its configuration, and therefore use of this cooling apparatus does not complicate or increase the cost of the apparatus.

This fixing apparatus 200 according to Embodiment 1 is also provided with a controller (not shown) that controls excitation apparatus 230 and the above-described cooling apparatus so that recording paper 109 is not passed through and heat-producing belt 210 is cooled while being heated over the heating width when the small-size recording paper 109 is passed through until the temperature detected by paper non-passage area temperature detecting sensor 260*x* is at or below a predetermined temperature at which fixing is possible. The operation of this controller will now be explained.

Figure 11:
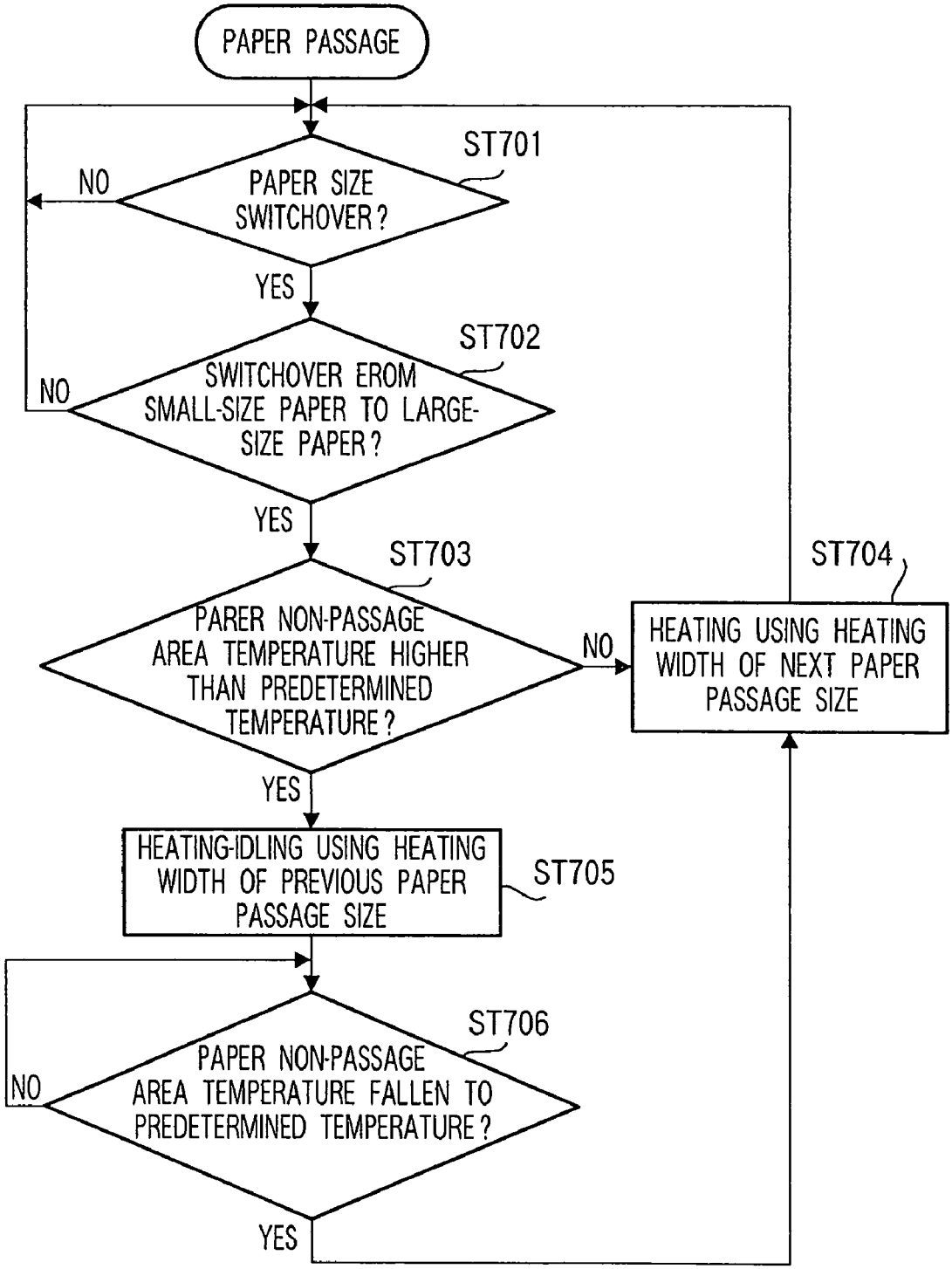
FIG. 11 is a flowchart showing the operation of a controller of a fixing apparatus according to Embodiment 1 of the present invention.

FIG. 11 is a flowchart showing an example of the operation of the above-described controller. In FIG. 11, when passage of paper to fixing apparatus 200 is started, it is first determined in step ST701 whether or not switching of the paper size of recording paper 109 passed through has been performed. If it is determined here that switching of the paper size of recording paper 109 passed through has not been performed, the system waits for switching of the paper size of recording paper 109 passed through to be performed.

If it is determined instep ST701 that switching of the paper size of recording paper 109 passed through has been performed, the processing flow proceeds to step ST702, and it is determined whether or not the paper size of recording paper 109 passed through has been switched from small-size paper to large-size paper. If it is determined here that switching from small-size paper to large-size paper has not been performed, the processing flow returns to step ST701.

If it is determined in step ST702 that switching from small-size paper to large-size paper has been performed, the processing flow proceeds to step ST703, and based on the temperature detected by above-described paper non-passage area temperature detecting sensor 260*x*, it is determined whether or not a paper non-passage area of heat-producing belt 210 is higher than a predetermined temperature. If it is determined here that a paper non-passage area of heat-producing belt 210 is lower than the predetermined temperature, the processing flow proceeds to step ST704, heat-producing belt 210 is heated over the heating width of the next paper passage size (the aforementioned large-size paper), and then the processing flow returns to step ST701.

If it is determined in step ST703 that a paper non-passage area of heat-producing belt 210 is higher than the predetermined temperature, the processing flow proceeds to step ST705, and heat-producing belt 210 is heating-idled over the heating width of the previous paper passage size (the aforementioned small-size paper).

Then, in step ST706, it is determined whether or not a paper non-passage area of heat-producing belt 210 has fallen to a predetermined temperature. If it is determined here that a paper non-passage area of heat-producing belt 210 has not fallen to the predetermined temperature, the system waits until a paper non-passage area of heat-producing belt 210 falls to the predetermined temperature.

If it is determined in step ST706 that a paper non-passage area of heat-producing belt 210 has fallen to the predetermined temperature, the processing flow proceeds to step ST704, heat-producing belt 210 is heated over the heating width of the next paper passage size (the aforementioned large-size paper), and then the processing flow returns to step ST701.

Thus, in this fixing apparatus 200, when recording paper 109 has not been passed through, heat-producing belt 210 continues to be heated by excitation apparatus 230 over the heating width when above-described small-size paper is passed through, and the entire paper passage area of heat-producing belt 210 is cooled by the above-described cooling apparatus.

By this means, the paper passage area of heat-producing belt 210 in which above-described small-size paper was passed through is maintained at a predetermined fixing temperature without a fall in temperature due to the above-described cooling by being heated by excitation apparatus 230. On the other hand, a paper non-passage area of heat-producing belt 210 that has undergone an excessive rise in temperature due to the passage of above-described small-size paper is rapidly lowered in temperature by the above-described cooling apparatus since the thermal capacity of heat-producing belt 210 is small.

Figure 12:
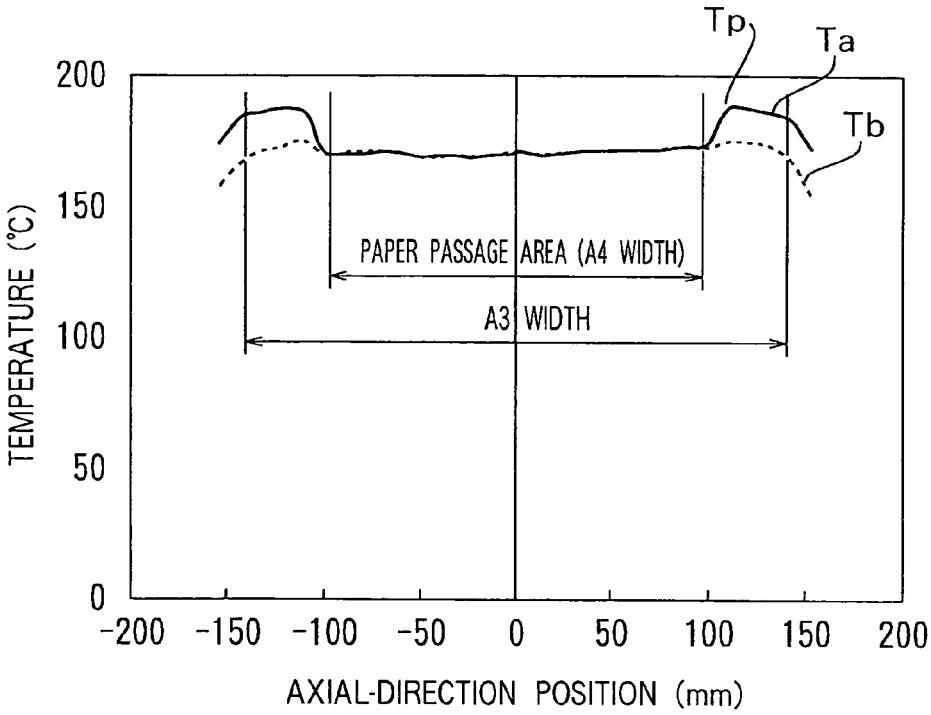
FIG. 12 is a graph showing the distribution of heat-producing temperature in the heating width direction of a heat-producing belt of a fixing apparatus according to Embodiment 1 of the present invention.

Therefore, as shown in FIG. 12, for example, according to this fixing apparatus 200, an excessive rise in temperature "Ta" of a paper non-passage area of heat-producing belt 210 can be efficiently eliminated as illustrated by temperature "Tb" shown by the dashed line in FIG. 12, and the temperature distribution of heat-producing belt 210 can be made uniform in a short time.

Since only a paper non-passage area of heat-producing belt 210 that has undergone an excessive rise in temperature is lowered in temperature in this way, temperature unevenness is eliminated in a short time. Also, since the paper passage area of heat-producing belt 210 is maintained at the fixing temperature, immediate switchover to the passage of large-size paper is possible.

Even in a conventional fixing apparatus in which diverted flow of magnetic flux occurs, when an excessive rise in temperature of a paper non-passage area of the heat-producing element occurs, the temperature distribution of the heat-producing element can be made uniform if the heat-producing element continues to be heated over the heating width when small-size paper is passed through, and rotational cooling is carried out whereby idling is performed when paper is not passed through.

At this time, although a paper non-passage area of this heat-producing element is heated by diverted flow of magnetic flux, heating power of heat-producing element is extremely low since paper is not being passed through. That is to say, a paper non-passage area of the heat-producing element is only heated to some extent, and the fall in temperature due to idling cooling is greater since the thermal capacity of the heat-producing element is small. As a result, the temperature distribution of the heat-producing element can be made uniform. Also, even in a conventional fixing apparatus that uses a plurality of halogen lamps, when an excessive rise in temperature of a paper non-passage area of the heat-producing element occurs, the temperature distribution of the heat-producing element can be made uniform if the heat-producing element continues to be heated over the heating width when small-size paper is passed through, and rotational cooling is carried out whereby idling is performed when paper is not passed through.

In this fixing apparatus 200 according to Embodiment 1, the temperature distribution of heat-producing belt 210 is made uniform by having excitation apparatus 230 and the above-described cooling apparatus controlled by the above-described controller after above-described small-size paper has been passed through and before large-size paper of larger size than that small-size paper is passed through.

Therefore, with this fixing apparatus 200, even if heat-fixing of large-size paper is performed after the passage of above-described small-size paper, susceptibility to deterioration of image quality of this large-size paper, such as the occurrence of hot offset or unevenness of the glossiness of fixed images, is eliminated.

EMBODIMENT 2

Next, a fixing apparatus according to Embodiment 2 will be described. This fixing apparatus is configured so that its controller controls excitation apparatus 230 and the above-described cooling apparatus on receiving a detection signal that detects that the number of above-described small-size paper sheets consecutively passed through has reached a predetermined number.

Here, a detection signal that detects that the number of above-described small-size paper sheets consecutively passed through has reached a predetermined number is output, for example, from a counter (not shown) that counts the quantity of recording paper 109 fed from paper feed apparatus 107 of image forming apparatus 100 shown in FIG. 4 to the aforementioned controller. The value when the temperature of a paper non-passage area exceeds a predetermined temperature based on prior experimentation (a temperature set lower than the heat-resistant temperature of heat-producing belt 210) is used as the value for the predetermined number of sheets.

According to this fixing apparatus of Embodiment 2, the temperature distribution of heat-producing belt 210 is made uniform by having excitation apparatus 230 and the above-described cooling apparatus controlled by the above-described controller on receiving a detection signal that detects that above-described small-size paper has been continuously passed through and the number of these small-size paper sheets consecutively passed through has reached a predetermined number—that is, before the temperature of a paper non-passage area of heat-producing belt 210 rises and exceeds the heat-resistant temperature of heat-producing belt 210 due to continuous heat-fixing on recording paper 109 of the same size.

Therefore, in this fixing apparatus, an excessive rise in temperature of a paper non-passage area of heat-producing belt 210 when heat-fixing is performed continuously on recording paper 109 of the same size can be suppressed.

EMBODIMENT 3

Next, a fixing apparatus according to Embodiment 3 will be described. This fixing apparatus is configured so that its controller controls excitation apparatus 230 and the above-described cooling apparatus when above-described small-size paper has been continuously passed through and the temperature detected by paper non-passage area temperature detecting sensor 260*x* has exceeded a predetermined temperature (a temperature set lower than the heat-resistant temperature of heat-producing belt 210).

Figure 13:
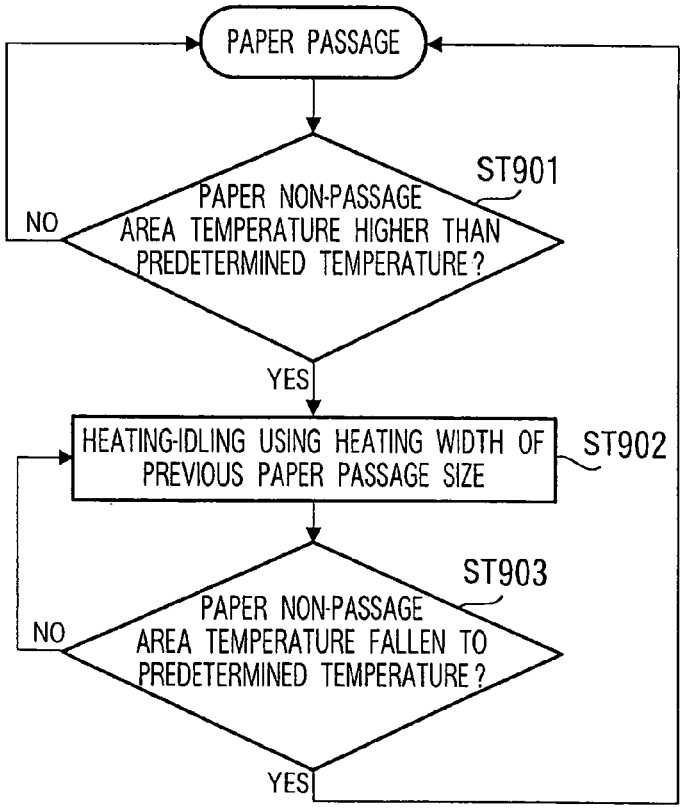
FIG. 13 is a flowchart showing the operation of a control apparatus of a fixing apparatus according to Embodiment 3 of the present invention.

FIG. 13 is a flowchart showing the operation of a controller of this fixing apparatus according to Embodiment 3. In FIG. 13, when passage of paper to fixing apparatus 200 is started, it is first determined in step ST901 whether or not a paper non-passage area of heat-producing belt 210 is higher than a predetermined temperature based on the temperature detected by above-described paper non-passage area temperature detecting sensor 260*x*. If it is determined here that a paper non-passage area of heat-producing belt 210 is lower than the predetermined temperature, continuous passage of the above-described small-size paper is continued.

On the other hand, if it is determined in step ST901 that a paper non-passage area of heat-producing belt 210 is higher than the predetermined temperature, the processing flow proceeds to step ST902, and heat-producing belt 210 is heating-idled over the heating width of the previous paper passage size (the aforementioned small-size paper).

Then, in step ST903, it is determined whether or not a paper non-passage area of heat-producing belt 210 has fallen to the predetermined temperature. If it is determined here that a paper non-passage area of heat-producing belt 210 has not fallen to the predetermined temperature, the system waits until a paper non-passage area of heat-producing belt 210 falls to the predetermined temperature.

Then, when it is determined in step ST903 that a paper non-passage area of heat-producing belt 210 has fallen to the predetermined temperature, the processing flow returns to step ST901, and continuous passage of the aforementioned small-size paper is started again.

According to this fixing apparatus of Embodiment 3, the temperature distribution of heat-producing belt 210 is made uniform by having excitation apparatus 230 and the above-described cooling apparatus controlled by the above-described controller when above-described small-size paper has been continuously passed through and the temperature detected by paper non-passage area temperature detecting sensor 260*x* has exceeded the predetermined fixing temperature—that is, in a situation in which an excessive rise in temperature of a paper non-passage area of heat-producing belt 210 continues to occur due to continuous heat-fixing on recording paper 109 of the same size.

Therefore, with this configuration, an excessive rise in temperature of a paper non-passage area of heat-producing belt 210 when heat-fixing is performed continuously on recording paper 109 of the same size can be suppressed more surely.

EMBODIMENT 4

Next, a fixing apparatus according to Embodiment 4 will be described. This fixing apparatus is configured so that the heating width of its heat-producing belt 210 is changed so that, as shown in FIG. 14 for example, when the actual paper passage width of recording paper 109 passed through to heat-producing belt 210 (here, A5 size) differs from the heating widths of heat-producing belt 210 that can be changed to (here, A3 size, B4 size, and A4 size) (this paper passage width hereinafter being referred to as "nonstandard-size"), the paper passage area of heat-producing belt 210 when recording paper 109 one size larger than this actual recording paper 109 paper passage width is passed through (here, A4 size) is made to produce heat.

According to this fixing apparatus, when nonstandard-size recording paper 109 is passed through, a paper passage area of heat-producing belt 210 one size larger than the paper passage width of that nonstandard-size recording paper 109 is heated.

Figure 14:
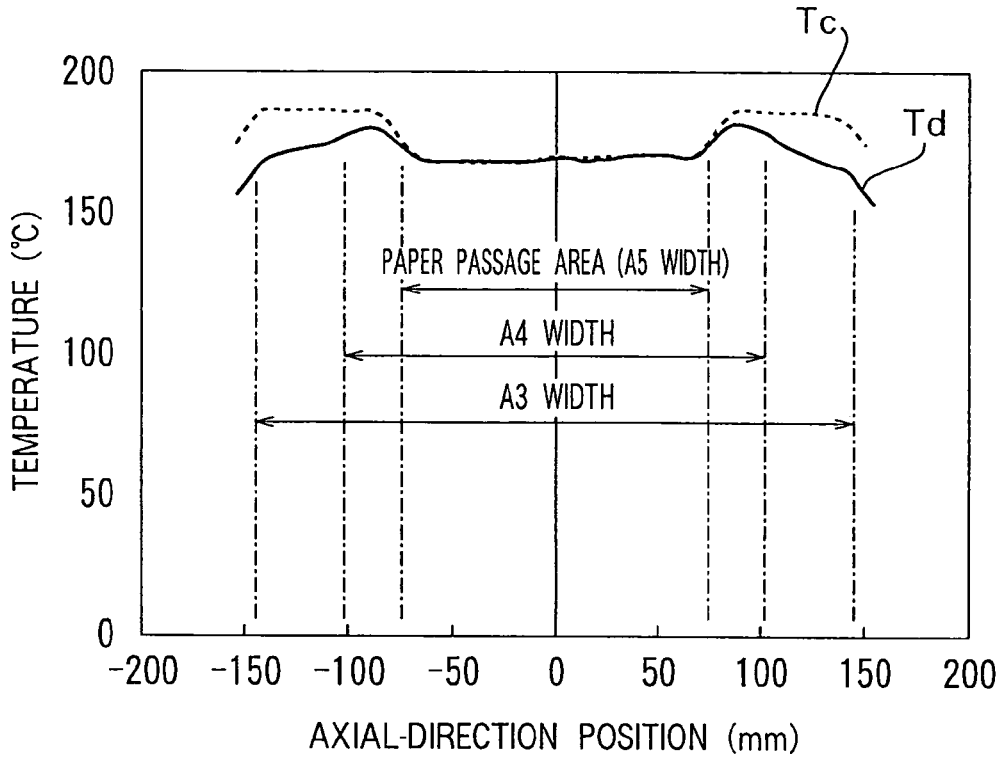
FIG. 14 is a graph showing the distribution of heat-producing temperature in the heating width direction of a heat-producing belt of a fixing apparatus according to Embodiment 4 of the present invention.

Therefore, while the temperature in a conventional fixing apparatus (with an A3 heating width) is temperature "Tc" shown by the dashed line in FIG. 14, in this fixing apparatus heat-fixing can be performed using the narrowest heating width allowing normal fixing of above-described nonstandard-size recording paper 109, and an excessive rise in temperature of paper non-passage areas of heat-producing belt 210 can be greatly suppressed, as illustrated by temperature "Td" shown by the solid line in FIG. 14. That is to say, continuous passage of above-described nonstandard-size recording paper 109 that tends to cause an excessive rise in temperature of paper non-passage areas of heat-producing belt 210 becomes possible.

EMBODIMENT 5

Next, a fixing apparatus according to Embodiment 5 will be described. As shown in FIG. 5 and FIG. 6, this fixing apparatus is equipped with a blower fan 280 serving as a forced draft cooling apparatus that cools at least paper non-passage areas of heat-producing belt 210 with blown air.

According to this fixing apparatus, when above-described nonstandard-size recording paper 109 is passed through and paper non-passage areas of heat-producing belt 210 rise in temperature, the temperature of at least paper non-passage areas of heat-producing belt 210 can be lowered indirectly by cooling pressure roller 250 by means of blower fan 280. That is to say, an excessive rise in temperature of paper non-passage areas of heat-producing belt 210 is eliminated more efficiently and continuous passage of above-described nonstandard-size recording paper 109 becomes possible.

Also, if a forced draft cooling apparatus is used as an addition to Embodiment 1, the temperature of paper non-passage areas of heat-producing belt 210 can be lowered immediately, enabling the temperature distribution of heat-producing belt 210 to be made uniform in a short time.

Forced draft cooling by blower fan 280 may also be performed during passage of small-size paper. This enables an excessive rise in temperature of paper non-passage areas of heat-producing belt 210 to be prevented more effectively.

In Embodiment 5 a configuration has been described in which pressure roller 250 is cooled by blower fan 280, but a configuration may also be used in which heat-producing belt 210 is cooled directly.

EMBODIMENT 6

Figure 15:
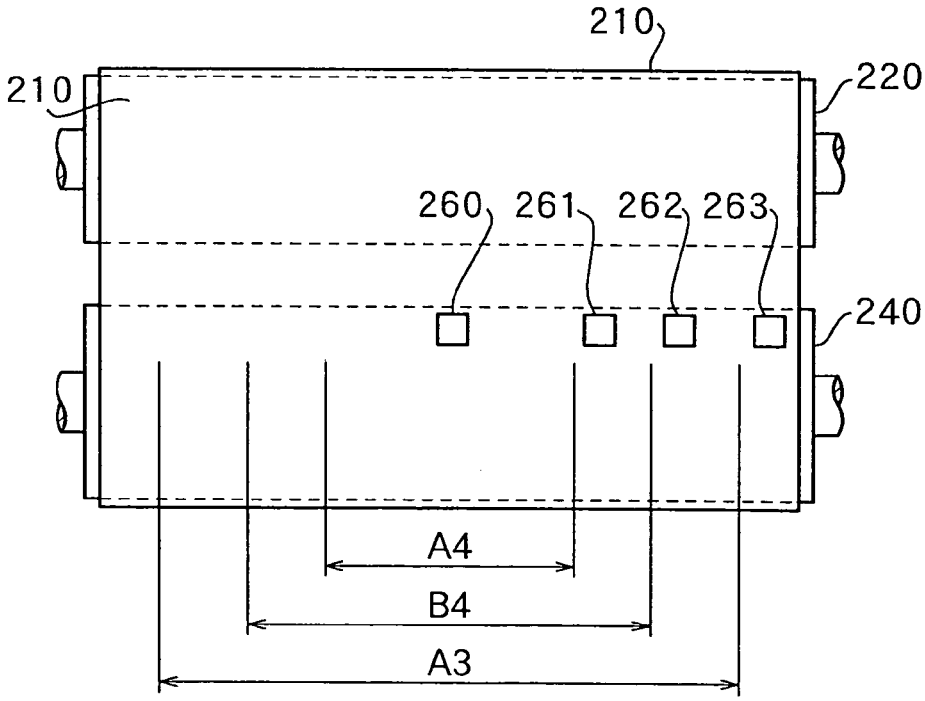
FIG. 15 is a schematic side view showing the configuration of the principal parts of a fixing apparatus according to Embodiment 6 of the present invention.

Next, a fixing apparatus according to Embodiment 6 will be described. This fixing apparatus has a configuration in which paper non-passage area temperature detecting sensor 260*x* comprises, for example, a plurality of temperature detectors 261, 262, and 263 that detect the temperatures of paper non-passage areas of the above-described plurality of heating widths of heat-producing belt 210 that can be changed to (here, A4 size, B4 size, and A3 size), as shown in FIG. 15.

According to this fixing apparatus, the temperature of paper non-passage areas of a plurality of heating widths of heat-producing belt 210 can be detected appropriately by these temperature detectors 261, 262, and 263, enabling an excessive rise in temperature of paper non-passage areas of a plurality of heating widths of heat-producing belt 210 to be eliminated more efficiently, and the temperature distribution of heat-producing belt 210 to be made uniform in a short time.

Also, in this fixing apparatus, when the heating width of heat-producing belt 210 is changed, for example, from an A4 size paper passage state to an A3 size paper passage state, the presence of temperature unevenness of the A3 size paper passage area of heat-producing belt 210 can be detected by comparing the temperature of a paper non-passage area of heat-producing belt 210 detected by temperature detector 261 when A4 size paper is passed through with the temperature of a paper non-passage area of heat-producing belt 210 detected by temperature detector 262 when B4 size paper is passed through.

EMBODIMENT 7

Figure 16:
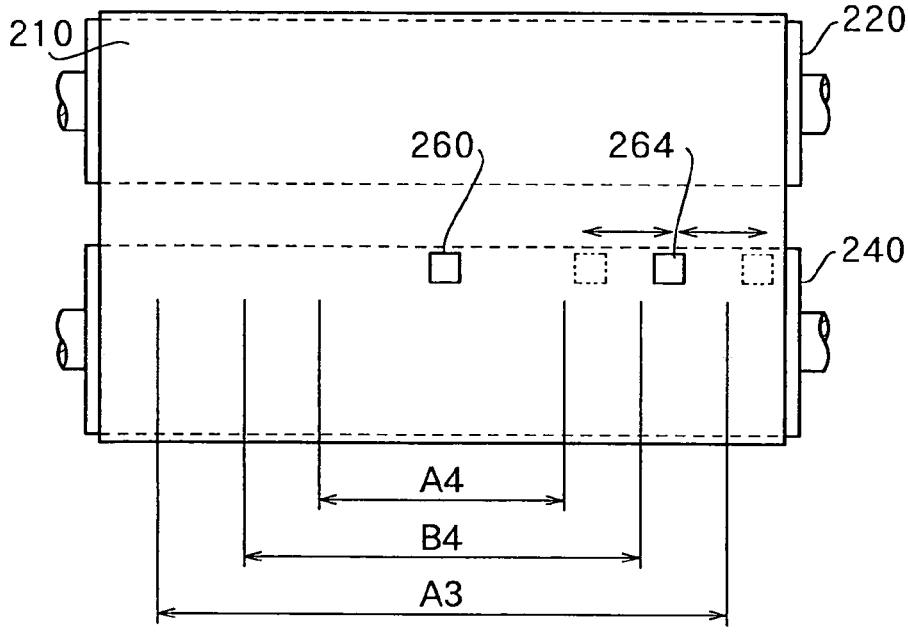
FIG. 16 is a schematic side view showing the configuration of the principal parts of a fixing apparatus according to Embodiment 7 of the present invention.

Next, a fixing apparatus according to Embodiment 7 will be described. This fixing apparatus has a configuration in which paper non-passage area temperature detecting sensor 260*x* comprises, for example, a freely movable single temperature detector 264 that detects the temperatures of paper non-passage areas of a plurality of heating widths of heat-producing belt 210 that can be changed to by means of above-described magnetism masking elements 301*a*, 301*b*, and 301*c* (here, A4 size, B4 size, and A3 size) as shown in FIG. 16.

According to this fixing apparatus, since the temperatures of paper non-passage areas of a plurality of heating widths of heat-producing belt 210 can be detected by a single temperature detector 264, the temperature detection circuitry of paper non-passage area temperature detecting sensor 260*x* can be simplified and reduced in cost.

EMBODIMENT 8

Next, a fixing apparatus according to Embodiment 8 will be described. This fixing apparatus has a configuration in which above-described temperature detectors 261, 262, and 263 detect the temperatures of paper non-passage areas of heat-producing belt 210 at a position at which temperature of a paper non-passage area of heat-producing belt 210 is a peak value.

According to this fixing apparatus, since the peak value of a heat-producing belt 210 paper non-passage area temperature can be detected by temperature detectors 261, 262, and 263, the presence of an excessive rise in temperature of a paper non-passage area of heat-producing belt 210 can be detected quickly and accurately. Here, the aforementioned position at which a heat-producing element paper non-passage area temperature is a peak value can be determined by means of prior experimentation.

Figure 17:
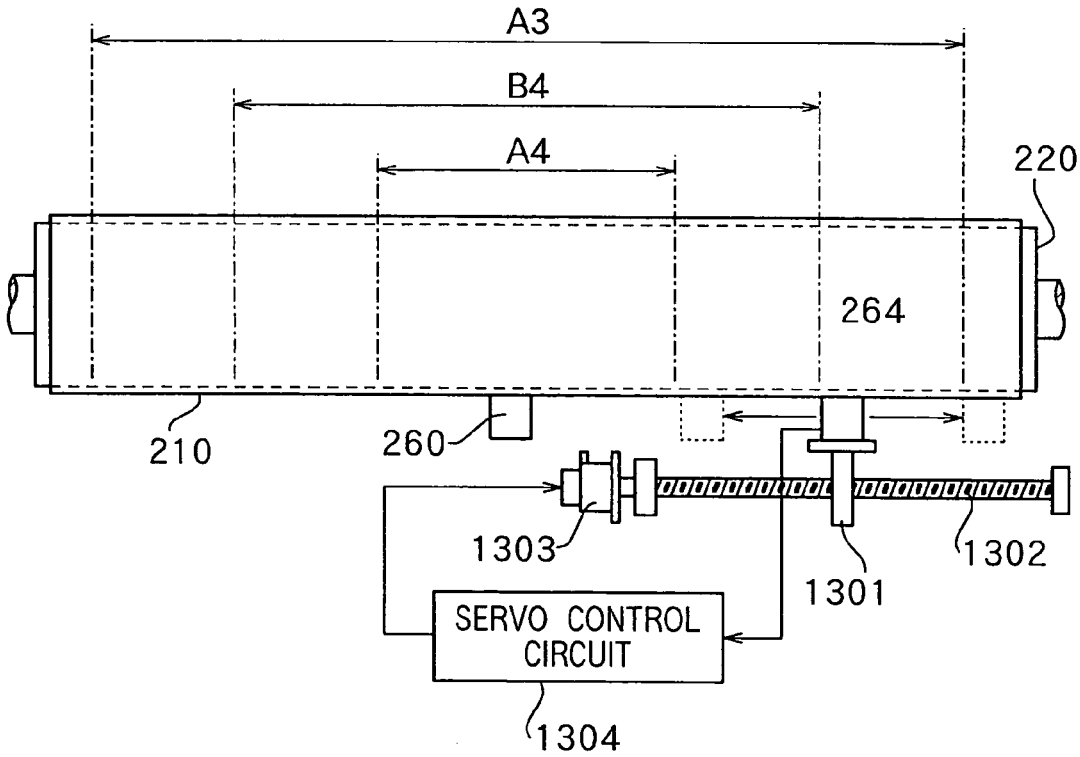
FIG. 17 is a schematic plan view showing an example of a servo control mechanism that stops the movement of a temperature detector of a fixing apparatus according to Embodiment 8 of the present invention at a position at which the temperature of a paper non-passage area of the heat-producing belt becomes a peak value.

As temperature detector 264 shown in FIG. 16 is freely movable, provision may be made for its movement to be stopped at a position at which a heat-producing belt 210 paper non-passage area temperature is a peak value by means of servo control. FIG. 17 is a schematic plan view showing an example of a servo control mechanism that stops the movement of this temperature detector 264 at a position at which a heat-producing belt 210 paper non-passage area temperature is a peak value.

In FIG. 17, temperature detector 264 is installed on a table 1301. Table 1301 is moved to the left or right across heat-producing belt 210 by the rotation of a ball screw 1302. Ball screw 1302 is rotated in a forward or reverse direction by means of a drive motor 1303. Drive motor 1303 is subjected to servo control by a servo control circuit 1304 so as to move to and stop at a position at which the temperature detected by temperature detector 264 is the maximum temperature (peak temperature).

Next, an image forming apparatus that incorporates a fixing apparatus according to above-described Embodiment 4 will be described. A fixing apparatus installed in this image forming apparatus is configured so that the heating width of its heat-producing belt 210 is changed so that, as shown in FIG. 15 for example, when the above-described heating widths of heat-producing belt 210 that can be changed to (here, A3 size, B4 size, and A4 size) and the actual paper passage width of recording paper 109 passed through to heat-producing belt 210 (here, A5 size) are different, the paper passage area of heat-producing belt 210 when recording paper 109 one size larger than this actual recording paper 109 paper passage width is passed through (here, A4 size) is made to produce heat.

This image forming apparatus is configured so that, when the changeable heating widths of heat-producing belt 210 and the actual paper passage width of recording paper 109 passed through to heat-producing belt 210 are different, as described above, the paper feed interval of paper feed apparatus 107 (see FIG. 4) for recording paper 109 is made longer than the normal paper feed interval.

According to this image forming apparatus, since the paper feed interval of paper feed apparatus 107 for recording paper 109 is longer than the normal paper feed interval, the heat dissipation time (cooling time) of paper non-passage areas of heat-producing belt 210 of this fixing apparatus increases. That is to say, an excessive rise in temperature of paper non-passage areas of heat-producing belt 210 can be suppressed.

Furthermore, in this image forming apparatus, the temperature of paper non-passage areas of heat-producing belt 210 can be lowered by means of blower fan 280.

Therefore, in this image forming apparatus, heat-fixing of above-described nonstandard-size recording paper 109 can be performed using the narrowest heating width, and an excessive rise in temperature of paper non-passage areas of heat-producing belt 210 can be further suppressed, making it more possible to perform continuous passage of above-described nonstandard-size recording paper 109 that tends to cause an excessive rise in temperature of paper non-passage areas of heat-producing belt 210.

In fixing apparatuses 200 according to the above-described embodiments, examples have been shown in which heat-producing belt 210 is used as a heat-producing element that heat-fixes unfixed toner image 111 on recording paper 109, but a configuration may also be used in which this heat-producing element is a roller or plate-shaped member.

When maximum-size recording paper is passed through continuously, areas outside the maximum paper passage area in the paper passage width direction of the heat-producing element are also heated to some extent, and therefore heat is also gradually accumulated in these areas.

Therefore, with a conventional fixing apparatus of this kind, areas outside the maximum paper passage area in the paper passage width direction of the heat-producing element (heating roller) undergo an excessive rise in temperature due to the accumulation of heat resulting from this continuous paper passage. This phenomenon becomes more pronounced the smaller the thermal capacity of the heat-producing element.

Thus, fixing apparatuses in which an excessive rise in temperature of areas outside the maximum paper passage area in the paper passage width direction of the heat-producing element can be prevented will be described below. The fixing apparatuses described below have the same basic configuration as the fixing apparatuses shown in Embodiment 1 through Embodiment 8 above, and additionally include a structure as described below that prevents an excessive rise in temperature of areas outside the maximum paper passage area. Therefore, in the following descriptions, explanations and references to drawings are omitted for configuration elements and operational effects described in detail in Embodiment 1 through Embodiment 8.

EMBODIMENT 9

Figure 18:
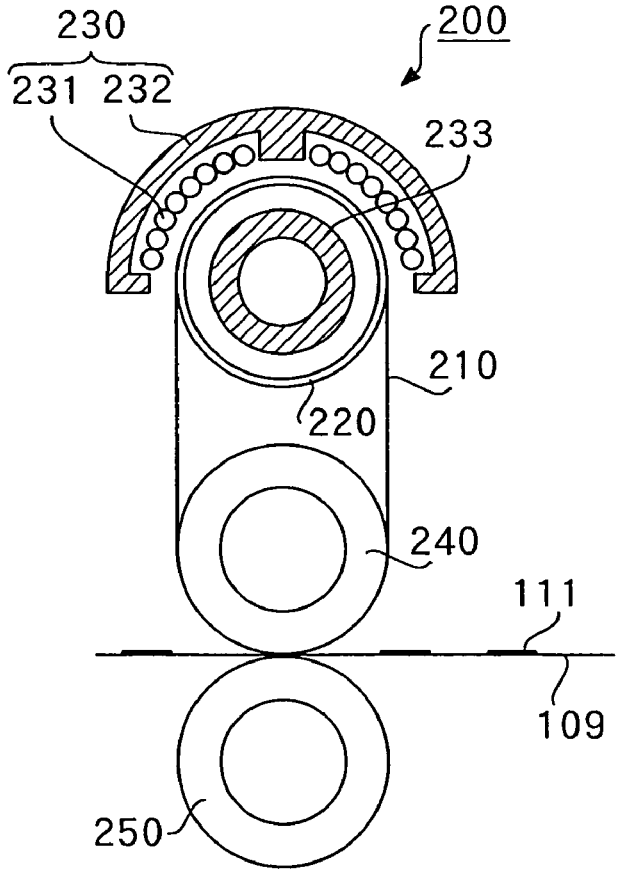
FIG. 18 is a schematic cross-sectional view showing the configuration of the principal parts of a fixing apparatus according to Embodiment 9 of the present invention.

Next, a fixing apparatus according to Embodiment 9 will be described. As shown in FIG. 18, except for magnetism masking elements 301*a*, 301*b*, and 301*c*, this fixing apparatus has the same basic configuration as above-described fixing apparatus 200 shown in FIG. 6, and therefore identical parts are assigned the same codes.

Figure 28:
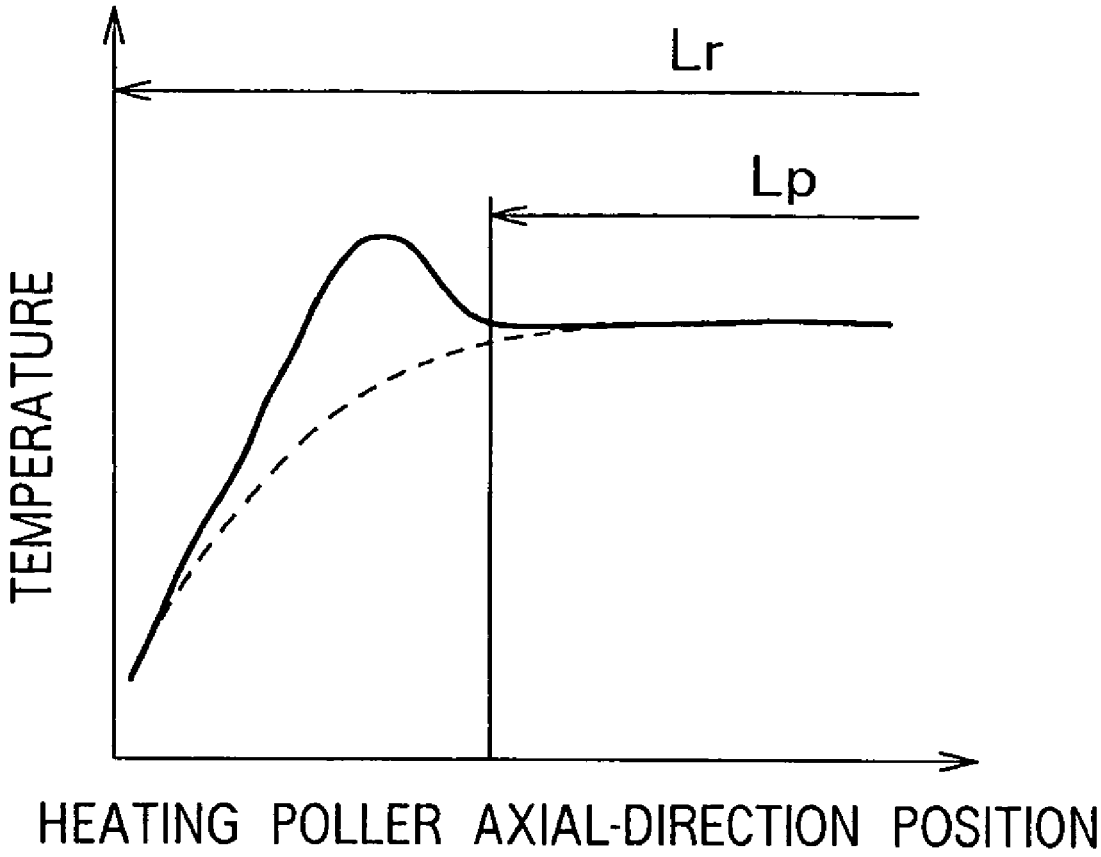
FIG. 28 is a graph showing the distribution of heat-producing temperature in the axial direction of a heating roller in the case of continuous passage of maximum-size recording paper in a typical fixing apparatus.

With a conventional fixing apparatus of this kind, the temperature of an area outside the maximum paper passage area in the paper passage width direction of the heating roller corresponding to heat-producing belt 210, which had fallen, as shown by the dashed line in FIG. 28, rises due to the accumulation of heat resulting from continuous paper passage, and a state of an excessive rise in temperature occurs, as shown by the solid line in FIG. 28.

Figure 19:
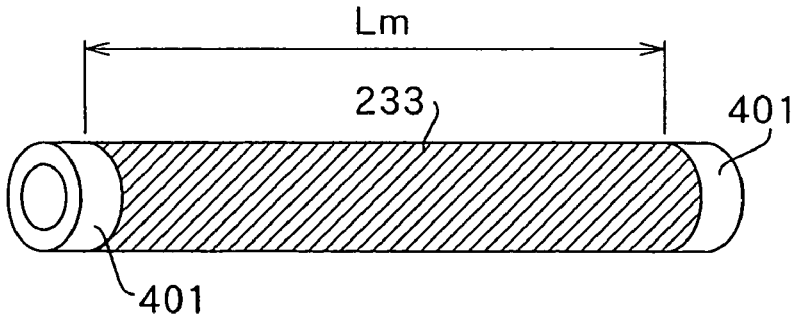
FIG. 19 is a schematic oblique drawing showing a configuration in which magnetism masking elements are provided at both ends of an opposed core of a fixing apparatus according to Embodiment 9 of the present invention.

Thus, in fixing apparatus 200 according to Embodiment 9, magnetism masking elements 401 of a material that can mask magnetism are provided at both ends of opposed core 233, as shown in FIG. 19. A low-permeability electrical conductor such as copper or aluminum can be used as the material of these magnetism masking elements 401.

Figure 20:
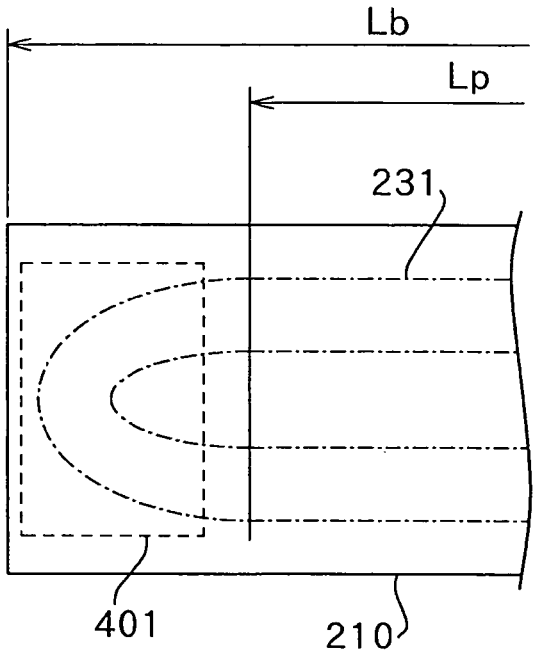
FIG. 20 is a schematic plan view showing the installation location of a magnetism masking element of a fixing apparatus according to Embodiment 9 of the present invention.
Figure 26:
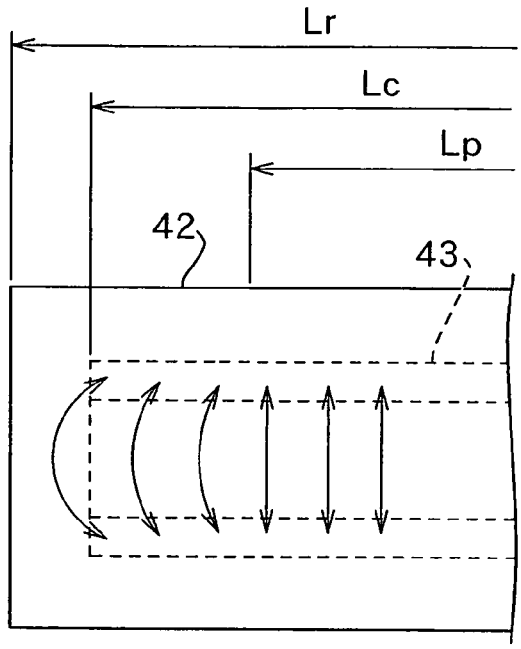
FIG. 26 is an explanatory drawing showing the relationship between the heating roller and the magnetic field generation apparatus and recording paper.
Figure 27:
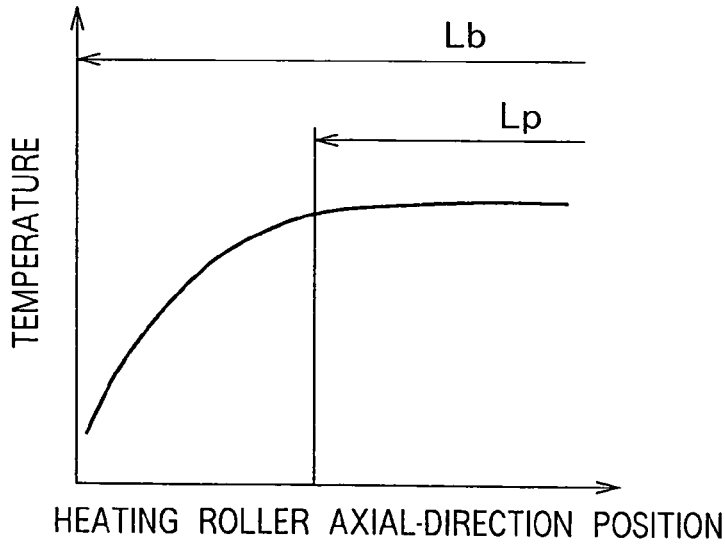
FIG. 27 is a graph showing the distribution of heat-producing temperature in the axial direction of a heating roller in a typical fixing apparatus.

As shown in FIG. 20, magnetism masking elements 401 in this fixing apparatus 200 according to Embodiment 9 are positioned so as to correspond to areas outside the maximum paper passage area in the paper passage width direction (maximum paper width Lp paper passage area in FIG. 26) of heat-producing belt 210 of maximum width Lb. In other words, as shown in FIG. 19, lengthwise effective maximum width Lm of opposed core 233 has a length corresponding to the width of the maximum-size recording paper 109 that can be fixed by this fixing apparatus 200 (corresponding to maximum paper width Lp in FIG. 26).

Figure 21:
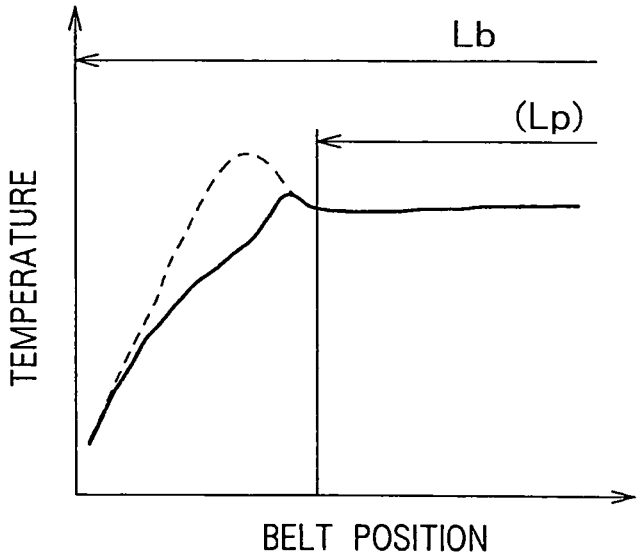
FIG. 21 is a graph showing the distribution of heat-producing temperature in the axial direction of a heating belt in a fixing apparatus according to Embodiment 9 of the present invention.

In this fixing apparatus 200, the magnetic flux density of magnetic fields acting on areas outside the maximum paper passage area in the paper passage width direction of heat-producing belt 210 can be lowered by the action of magnetism masking elements 401. Therefore, whereas in a conventional fixing apparatus, the temperature of an area outside the maximum paper passage area in the paper passage width direction of heat-producing belt 210 rises due to the accumulation of heat resulting from continuous paper passage, resulting in an excessive rise in temperature, as shown by the dashed line in FIG. 21, according to a fixing apparatus of Embodiment 9 of the present invention an excessive rise in temperature of an area outside the maximum paper passage area of heat-producing belt 210 can be prevented, as shown by the solid line in FIG. 21.

Also, as magnetic flux is generated at loopback locations of exciting coil 231, although its density is low, heating occurs here to some extent. However, as these magnetism masking elements 401 are provided at loopback locations of exciting coil 231, magnetic flux is effectively masked and an excessive rise in temperature of heat-producing belt 210 is prevented.

Furthermore, as magnetism masking elements 401 of this fixing apparatus 200 are provided as cylindrical electrical conductors of copper, aluminum, or the like at both ends of opposed core 233, as shown in FIG. 19, diverted flow of magnetic flux to both ends of opposed core 233 can be prevented, and magnetic flux can be sharply masked.

EMBODIMENT 10

Figure 22:
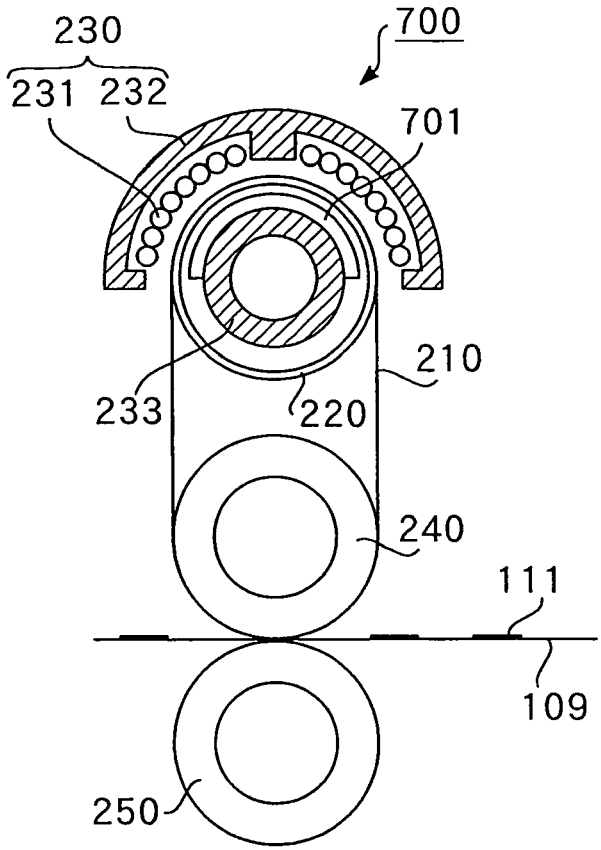
FIG. 22 is a schematic cross-sectional view showing the configuration of the principal parts of a fixing apparatus according to Embodiment 10 of the present invention.

Next, a fixing apparatus according to Embodiment 10 will be described. FIG. 22 is a schematic cross-sectional view showing the configuration of a fixing apparatus according to Embodiment 10. As shown in FIG. 22, in this fixing apparatus 700, magnetism masking elements 701 of a material that can mask magnetic flux are provided so as to cover approximately half of the peripheral surface of both ends of opposed core 233.

Figure 23:
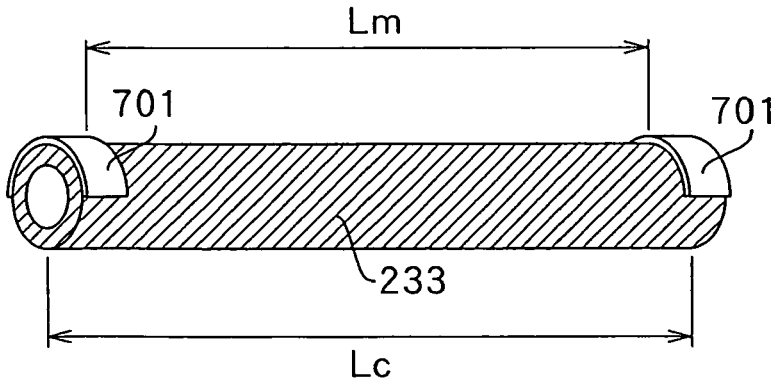
FIG. 23 is a schematic oblique drawing showing a configuration in which magnetism masking elements are provided on the peripheral surface of both ends of an opposed core of a fixing apparatus according to Embodiment 10 of the present invention.

As with above-described magnetism masking elements 401, a low-permeability electrical conductor such as copper or aluminum can be used as the material of magnetism masking elements 701 in fixing apparatus 700 according to Embodiment 10. As shown in FIG. 23, magnetism masking elements 701 are provided in areas outside lengthwise effective maximum width Lm of opposed core 233 of maximum width Lc.

As with above-described fixing apparatus 200, in this fixing apparatus 700, the magnetic flux density of magnetic fields acting on areas outside the maximum paper passage area in the paper passage width direction of heat-producing belt 210 can be lowered by the action of magnetism masking elements 701, and an excessive rise in temperature of areas outside the maximum paper passage area of heat-producing belt 210 can be prevented.

In this fixing apparatus 700 according to Embodiment 10, magnetism masking elements 701 are configured so as to be freely advanced and withdrawn with respect to magnetic fields acting on areas outside the maximum paper passage area in the paper passage width direction of heat-producing belt 210.

Figure 24:
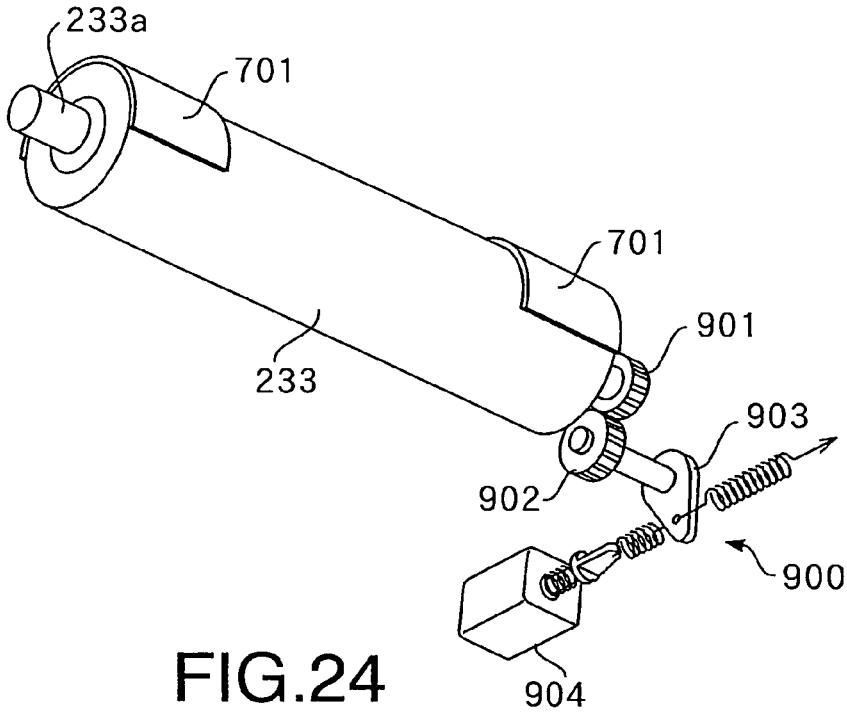
FIG. 24 is a schematic oblique drawing showing a magnetism masking element advancing/withdrawing section that advances/withdraws magnetism masking elements by rotating an opposed core of a fixing apparatus according to Embodiment 10 of the present invention.

FIG. 24 is a schematic oblique drawing showing a magnetism masking element 701 advancing/withdrawing section 900 that advances/withdraws magnetism masking elements 701 by rotating opposed core 233 constituting a supporting member of magnetism masking elements 701. As shown in FIG. 24, this advancing/withdrawing section 900 is composed of a small gear wheel 901 attached to the spindle 233*a* of opposed core 233, a large gear wheel 902 that meshes with small gear wheel 901, an arm 903 integral with the spindle of large gear wheel 902, a solenoid 904 that causes arm 903 to swing, and so forth.

In FIG. 24, when solenoid 904 is turned on (energized), the actuator of solenoid 904 moves and arm 903 swings. Through this swinging of arm 903, large gear wheel 902 rotates, and small gear wheel 901 rotates driven by large gear wheel 902. Through this driven rotation of small gear wheel 901, spindle 233*a* of opposed core 233 rotates, and magnetism masking elements 701 are moved to a position in which they are withdrawn from magnetic fields acting on areas outside the maximum paper passage area in the paper passage width direction of heat-producing belt 210.

On the other hand, when solenoid 904 in the above-described on state is turned off (de-energized), arm 903 returns to its initial position shown in FIG. 24, large gear wheel 902, small gear wheel 901, and spindle 233*a* of opposed core 233 are all rotated backward, and magnetism masking elements 701 are returned to a position in which they are advanced into magnetic fields acting on areas outside the maximum paper passage area in the paper passage width direction of heat-producing belt 210.

Thus, in fixing apparatus 700 according to Embodiment 10, by turning solenoid 904 of advancing/withdrawing section 900 on and off, magnetism masking elements 701 are advanced and withdrawn with respect to magnetic fields acting on areas outside the maximum paper passage area in the paper passage width direction of heat-producing belt 210, and control the magnetic fields acting on those areas.

That is to say, when areas outside the maximum paper passage area in the paper passage width direction of heat-producing belt 210 have risen excessively in temperature, solenoid 904 in FIG. 9 is left in the off state, and magnetic flux of magnetic fields acting on areas outside the maximum paper passage area in the paper passage width direction of heat-producing belt 210 are masked by magnetism masking elements 701.

On the other hand, when areas outside the maximum paper passage area in the paper passage width direction of heat-producing belt 210 have not risen excessively in temperature, such as when fixing apparatus 700 is warming up, solenoid 904 in FIG. 24 is turned on, and magnetism masking elements 701 are withdrawn from magnetic fields acting on areas outside the maximum paper passage area in the paper passage width direction of heat-producing belt 210. By this means, heat production by magnetism masking elements 701 themselves due to the action of the aforementioned magnetic fields can be prevented, and an unnecessary rise in temperature of the body of the apparatus can be prevented.

If the fixing temperature has been maintained for a long period of time, as when fixing apparatus 700 is in the standby state, heat is transferred since supporting roller 220 is pivoted in side plates of the body of fixing apparatus 700, and the temperature is prone to fall at both sides of heat-producing belt 210. In a case such as this, solenoid 904 in FIG. 24 is turned on, and magnetism masking elements 701 are withdrawn from magnetic fields acting on areas outside the maximum paper passage area in the paper passage width direction of heat-producing belt 210. By this means, it is possible to prevent a fall in temperature within the maximum paper passage area in the paper passage width direction of heat-producing belt 210.

EMBODIMENT 11

Figure 25:
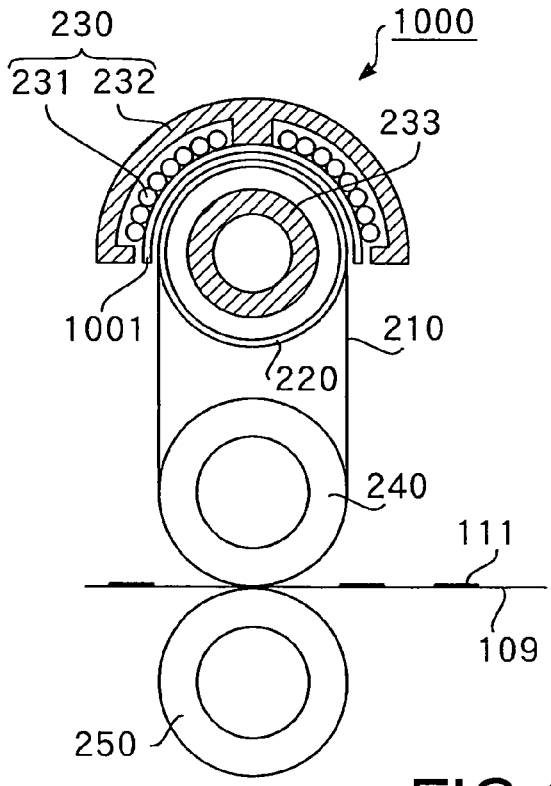
FIG. 25 is a schematic cross-sectional view showing the configuration of the principal parts of a fixing apparatus according to Embodiment 11 of the present invention.

Next, a fixing apparatus according to Embodiment 11 will be described. FIG. 25 is a schematic cross-sectional view showing the configuration of a fixing apparatus according to Embodiment 11. As shown in FIG. 25, in this fixing apparatus 1000, magnetism masking elements 1001 are provided so as to cover exciting coil 231 of excitation apparatus 230 constituting a magnetic field generation unit.

Here, magnetism masking elements 1001 are provided on a coil guide (not shown) serving as a supporting member provided integrally with exciting coil 231 and core 232 of excitation apparatus 230.

As in fixing apparatuses 200 and 700 according to above-described embodiments, these magnetism masking elements 1001 are positioned so as to correspond to areas outside the maximum paper passage area in the paper passage width direction (maximum paper width Lp paper passage area in FIG. 26) of heat-producing belt 210 of maximum width Lb (see FIG. 20).

Also, as in fixing apparatuses 200 and 700 according to above-described embodiments, a low-permeability electrical conductor such as copper or aluminum can be used as the material of these magnetism masking elements 1001.

In this fixing apparatus 1000, the magnetic flux density of magnetic fields acting on areas outside the maximum paper passage area in the paper passage width direction of heat-producing belt 210 can be lowered, and an excessive rise in temperature of those areas prevented, irrespective of the shape and installation location of opposed core 233.

In this fixing apparatus 1000, it is not necessary for a member for supporting magnetism masking elements 1001 to be newly provided, and therefore fixing apparatus 1000 is not made more complicated or expensive by the provision of magnetism masking elements 1001.

If heat production is suppressed by a magnetism masking element 401 for an area for which heating is not necessary, such as a loopback location of exciting coil 231, thermal efficiency improves, and therefore effects such as shortening of the temperature rise time and reduction of power consumption are obtained.

EMBODIMENT 12

Figure 29:
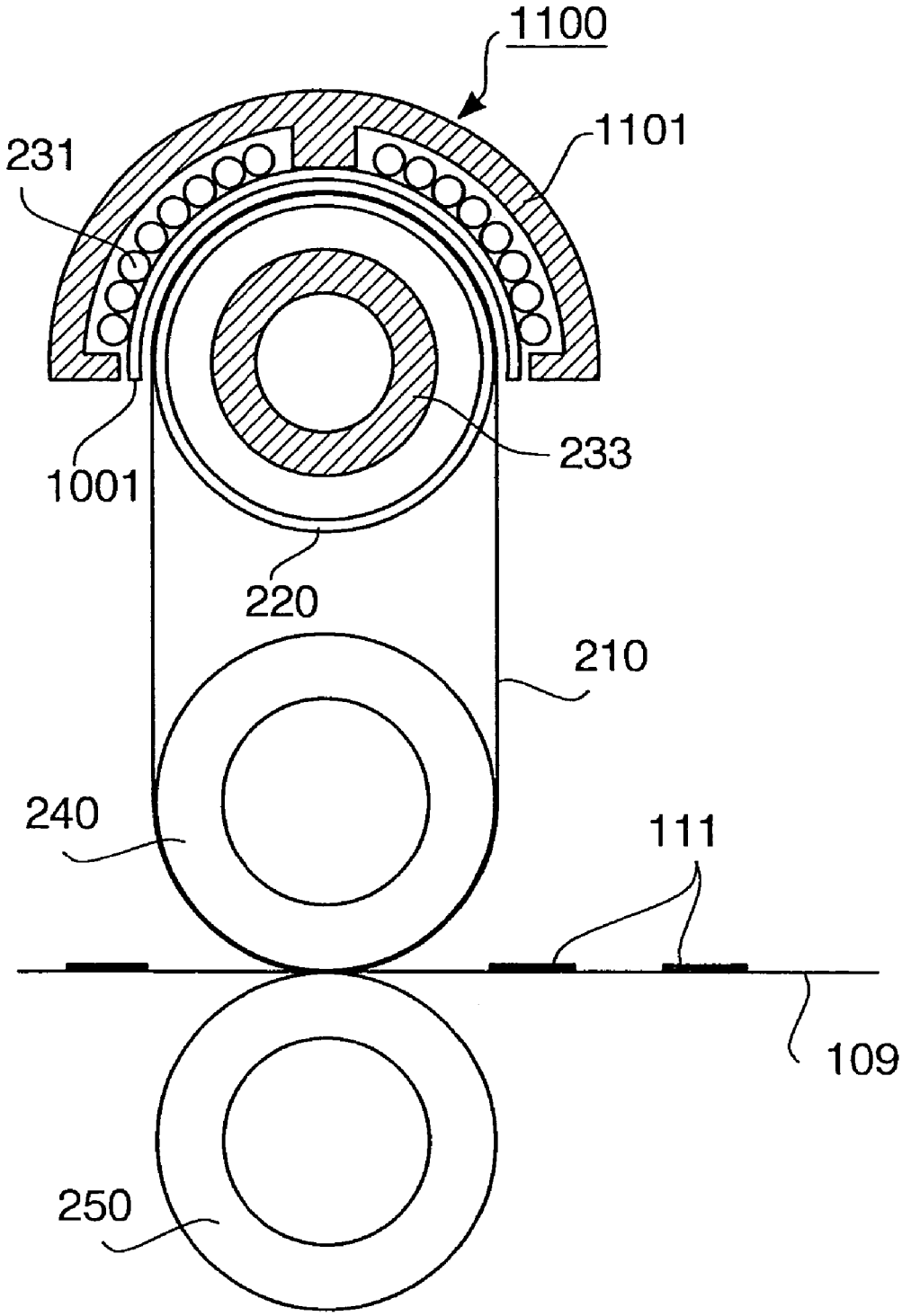
FIG. 29 is a schematic cross-sectional view showing the configuration of a fixing apparatus according to Embodiment 12 of the present invention.

Next, a fixing apparatus according to Embodiment 12 will be described. FIG. 29 is a schematic cross-sectional view showing the configuration of a fixing apparatus according to Embodiment 12. As shown in FIG. 29, in this fixing apparatus 1100, magnetism masking members 1101 are provided so as to cover exciting coil 231 corresponding to areas outside the maximum paper passage area in the paper passage width direction of heat-producing belt 210. That is to say, a left-and-right pair of magnetism masking members 1101 constitute both ends of core 232 and are provided in positions corresponding to loopback locations of exciting coil 231. With such a configuration, the magnetic flux density of magnetic fields acting on areas outside the maximum paper passage area in the paper passage width direction of heat-producing belt 210 can be further lowered.

In above-described Embodiments 9, 10, and 11, an excessive rise in temperature is prevented by using magnetism masking members, but an excessive rise in temperature cam also be suppressed by using forced draft cooling as in Embodiment 1 (see FIG. 6).

In fixing apparatuses 200, 700, and 1000 according to the above-described embodiments, examples have been shown in which heat-producing belt 210 is used as a heat-producing element that heat-fixes unfixed toner image 111 on recording paper 109, but a configuration may also be used in which this heat-producing element is a roller or plate-shaped member.

The present application is based on Japanese Patent Application No. 2003-358025, filed on Oct. 17, 2003, and Japanese Patent Application No. 2003-360040, filed on Oct. 20, 2003, the entire content of which is expressly incorporated herein by reference.

INDUSTRIAL APPLICABILITY

A fixing apparatus according to the present invention enables an excessive rise in temperature of a paper non-passage area in the paper passage width direction of a heat-producing element to be efficiently eliminated, and the temperature distribution of the heat-producing element to be made uniform in a short time, and is therefore useful as a fixing apparatus of an electrophotographic or electrostatographic copier, facsimile machine, printer, or the like.

The invention claimed is:

1. A fixing apparatus comprising:

a heat-producing element that heat-fixes an unfixed image on a recording medium onto the recording medium;

a heating apparatus that heats said heat-producing element;

a cooling apparatus that cools an entire paper passage area of said heat-producing element;

a heating width changing apparatus that changes a heating width of said heat-producing element so that, when a recording medium of smaller size than a maximum heating width of said heat-producing element is passed through, a paper passage width of the small-size recording medium is made to produce heat; and a control section that performs uniformizing control that directs said heating apparatus and also directs said cooling apparatus so that the recording medium is not passed through, and heating of a heating width that causes a paper passage area of the small-size recording medium to produce heat is maintained and an entire paper passage width of said heat-producing element is cooled, until the paper non-passage area of said heat-producing element is at or below a temperature at which fixing is possible.

2. The fixing apparatus according to claim 1, wherein:

said heat-producing element is a rotating element supported rotatably; and said cooling apparatus has a rotational drive apparatus that idles said heat-producing element in a paper non-passage state.

3. The fixing apparatus according to claim 1, wherein:

said heating apparatus has a magnetic flux generation apparatus that generates magnetic flux, and an opposed core located opposite the magnetic flux generation apparatus;

said heat-producing element is configured with a movable element that moves between the magnetic flux generation apparatus and the opposed core, and is induction-heated by magnetic flux that crosses with the movable element when the movable element passes between the magnetic flux generation apparatus and the opposed core; and said heating width changing apparatus has a magnetism masking element that moves relative to the magnetic flux generation apparatus in a direction of movement of said heat-producing element, and the magnetism masking element is displaced between a magnetic path blocking position in which a magnetic path corresponding to the paper non-passage area of said heat-producing element between the magnetic flux generation apparatus and the opposed core is blocked and a magnetic path clearing position in which the magnetic path is cleared.

4. The fixing apparatus according to claim 1, wherein said control section performs the uniformizing control when a recording medium of larger size than the small-size recording medium is passed through after the small-size recording medium has been passed through.

5. The fixing apparatus according to claim 1, wherein said control section performs the uniformizing control on receiving a detection signal that detects that a number of sheets of the small-size recording medium consecutively passed through has reached a predetermined number.

6. The fixing apparatus according to claim 1, further comprising at least one detecting element that detects a temperature of the paper non-passage area of said heat-producing element;

wherein said control section performs the uniformizing control when the detected temperature obtained by the detecting element has exceeded a predetermined temperature due to the fact that the small-size recording medium has been continuously passed through.

7. The fixing apparatus according to claim 1, wherein said heating width changing apparatus can change the heating width in steps, and when a paper passage width of the recording medium passed through to said heat-producing element and a heating width closest to that paper passage width are different, changes to a heating width larger than a paper passage width of the recording medium in one step.

8. The fixing apparatus according to claim 1, further comprising a forced draft cooling apparatus that cools at least a paper non-passage area of said heat-producing element by means of blown air.

9. The fixing apparatus according to claim 8, wherein: said heating width changing apparatus can change the heating width in steps; and said forced draft cooling apparatus, when a paper passage width of the recording medium passed through to said heat-producing element and a heating width closest to that paper passage width are different, cools at least a paper non-passage area of said heat-producing element.

10. The fixing apparatus according to claim 6, wherein the each detecting element is provided for each paper non-passage area corresponding to respective heating widths changeable by said heating width changing apparatus.

11. The fixing apparatus according to claim 10, wherein the detecting element detects a temperature of the paper non-passage area of said heat-producing element at a location where a temperature of the paper non-passage area is a peak value.

12. The fixing apparatus according to claim 6, wherein the detecting element is composed of one detecting element provided in a freely movable fashion between paper non-passage areas corresponding to respective heating widths changeable by said heating width changing apparatus.

13. The fixing apparatus according to claim 12, wherein the detecting element detects a temperature of the paper non-passage area of said heat-producing element at a location where a temperature of the paper non-passage area is a peak value.

14. The fixing apparatus according to claim 1, further comprising a magnetism masking element that lowers a magnetic flux density of a magnetic field that acts on an area outside a maximum paper passage area in a paper passage width direction of said heat-producing element.

15. The fixing apparatus according to claim 14, wherein:

said heating apparatus has a magnetic flux generation apparatus that includes an exciting coil that extends in a paper passage width direction of said heat-producing element and is wound so as to loop back outside a maximum paper passage area in a paper passage width direction of said heat-producing element; and said magnetism masking element is provided at a loopback location of the exciting coil.

16. The fixing apparatus according to claim 14, wherein:

said heating apparatus has a magnetic flux generation apparatus that generates magnetic flux, and an opposed core provided opposite the magnetic flux generation apparatus; and said magnetism masking element is provided on the opposed core.

17. The fixing apparatus according to claim 14, wherein said magnetism masking element can be freely advanced and withdrawn with respect to a magnetic field that acts on an area outside a maximum paper passage area in a paper passage width direction of said heat-producing element.

18. The fixing apparatus according to claim 14, wherein: said heating apparatus has a magnetic flux generation apparatus that generates magnetic flux; and said magnetism masking element is provided in the magnetic flux generation apparatus.

19. The fixing apparatus according to claim 18, wherein: the magnetic flux generation apparatus has an exciting coil that extends in a paper passage width direction of said heat-producing element and is wound so as to loop back outside a maximum paper passage area in a paper passage width direction of said heat-producing element; and said magnetism masking element is provided on at least one of an inner side or rear side of the exciting coil.

20. The fixing apparatus according to claim 14, wherein said magnetism masking element is a low-permeability electrical conductor.

21. An image forming apparatus comprising the fixing apparatus according to claim 1.

22. An image forming apparatus comprising:

an image forming section that forms an unfixed image on a recording medium; the fixing apparatus according to claim 1 that heat-fixes the unfixed image formed on the recording medium onto the recording medium; and a paper feed mechanism that feeds the recording medium toward said image forming section and the fixing apparatus at predetermined timing;

wherein a paper feed interval of said paper feed mechanism for the recording medium is longer than a normal paper feed interval.

23. A temperature control method comprising:

a heat-fixing step of heat-fixing an unfixed image on a recording medium onto the recording medium by means of a heat-producing element;

a heat-producing element heating step of heating the heat-producing element so that the heat-producing element maintains a predetermined fixing temperature;

a cooling step of cooling an entire paper passage area of the heat-producing element;

a heating width changing step of changing a heating width of the heat-producing element so that, when a recording medium of smaller size than a maximum heating width of the heat-producing element is passed through, a paper passage width of the small-size recording medium is made to produce heat; and a control step of performing uniformizing control so that the recording medium is not passed through, and heating of a heating width that causes a paper passage area of the small-size recording medium to produce heat is maintained and an entire paper passage width of the heat-producing element is cooled, until a paper non-passage area of the heat-producing element is at or below a predetermined temperature at which fixing is possible.

* * * * *